US009845628B2

(12) United States Patent
Jung et al.

(10) Patent No.: US 9,845,628 B2
(45) Date of Patent: Dec. 19, 2017

(54) REFRIGERATOR

(71) Applicant: LG ELECTRONICS INC., Seoul (KR)

(72) Inventors: Jaehun Jung, Seoul (KR); Seonil Yu, Seoul (KR); Hyokku Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/972,181

(22) Filed: Dec. 17, 2015

(65) Prior Publication Data

US 2016/0178268 A1 Jun. 23, 2016

(30) Foreign Application Priority Data

Dec. 17, 2014 (KR) ..... 10-2014-0182070
Dec. 17, 2014 (KR) ..... 10-2014-0182071

(51) Int. Cl.
*F25D 23/00* (2006.01)
*E05F 1/10* (2006.01)
*F25D 23/02* (2006.01)

(52) U.S. Cl.
CPC ..... *E05F 1/10* (2013.01); *E05F 1/105* (2013.01); *F25D 23/02* (2013.01); *E05Y 2900/31* (2013.01); *F25D 2323/021* (2013.01)

(58) Field of Classification Search
CPC ..... F25D 23/025; F25D 23/02; F25D 23/028; F25D 23/087; F25D 25/02; F25D 25/021;
(Continued)

(56) References Cited

U.S. PATENT DOCUMENTS 2,894,297 A * 7/1959 Viscolosi ..... E06B 7/18 49/303
4,265,051 A * 5/1981 Williams ..... E05F 5/12 49/367

(Continued)

FOREIGN PATENT DOCUMENTS

CN 103842751 6/2014
CN 103868314 6/2014

(Continued)

OTHER PUBLICATIONS

Extended European Search Report issued in European Application No. 15200273.9 dated Apr. 21, 2016, 9 pages.

(Continued)

*Primary Examiner* — Janet M Wilkens
(74) *Attorney, Agent, or Firm* — Fish & Richardson P.C.

(57) ABSTRACT

A refrigerator includes a cabinet; a storage compartment located within the cabinet; a first door pivotally mounted to the cabinet, the first door configured to open or close a first portion of the storage compartment; a second door pivotally mounted to the cabinet, the second door configured to open or close a second portion of the storage compartment; a pillar pivotally mounted to the first door and configured to block leakage of cold air between the first door and the second door; a pillar boss protruding outward from the pillar; a guide recess configured to guide the pillar boss; and a rotator that defines the guide recess, the rotator being configured to rotate about a rotation axis.

18 Claims, 22 Drawing Sheets

(58) Field of Classification Search
CPC . F25D 25/022; F25D 2323/021; Y10S 292/71
USPC ..... 312/405.1, 321.5, 405, 326, 329, 324; 49/480.1, 475.1, 478.1, 366, 367, 368, 49/365; 62/440, 441; 292/194, 219, 220
See application file for complete search history.

(56) References Cited

U.S. PATENT DOCUMENTS 4,711,098 A * 12/1987 Kuwabara ..... F25D 11/022 312/321.5
5,411,328 A * 5/1995 You ..... F25D 23/028 312/296
5,694,789 A * 12/1997 Do ..... F25D 23/02 312/405
5,722,202 A * 3/1998 Cooper ..... E05F 17/004 49/109
7,819,488 B2 * 10/2010 Lee ..... E05F 15/63 312/296
8,167,389 B2 * 5/2012 Han ..... F25D 23/02 16/250
8,292,383 B2 * 10/2012 Laible ..... E05B 65/0042 312/329
9,097,052 B2 * 8/2015 Chen ..... F25D 23/02
2005/0046319 A1 * 3/2005 Chekal ..... F25D 11/02 312/401
2006/0107597 A1 * 5/2006 Jin ..... E05F 15/63 49/149
2007/0257589 A1 * 11/2007 Laible ..... F25D 23/02 312/405
2009/0273264 A1 * 11/2009 Butler ..... F25D 23/028 312/405
2012/0137722 A1 * 6/2012 Kim ..... F25D 23/028 62/440
2013/0241385 A1 * 9/2013 Lee ..... F25D 23/028 312/404
2014/0097733 A1 * 4/2014 Seo ..... F25D 23/02 312/324
2014/0159560 A1 * 6/2014 Jung ..... F25D 23/028 312/405
2014/0375198 A1 * 12/2014 Jeon ..... F25D 23/00 312/404
2015/0219387 A1 * 8/2015 Kim ..... F25D 23/028 312/404

FOREIGN PATENT DOCUMENTS

| | | | |
|---|---|---|---|
| CN | 203758143 | | 8/2014 |
| GB | 2446047 | * | 7/2008 |
| KR | 20130026325 | * | 3/2013 |
| KR | 10-2014-0097787 | | 8/2014 |
| WO | 2012/123035 | | 9/2012 |
| WO | 2014/204238 | | 12/2014 |
| WO | 2015/105305 | | 7/2015 |

OTHER PUBLICATIONS

Chinese Office Action in Chinese Application No. 201510951866.5, dated Oct. 16, 2017, 10 pages (with English translation).

* cited by examiner

REFRIGERATOR

CROSS-REFERENCE TO RELATED APPLICATION

This application claims the benefit of Korean Patent Application Nos. 10-2014-0182070, filed on Dec. 17, 2014, and 10-2014-0182071, filed on Dec. 17, 2014 which are hereby incorporated by reference as if fully set forth herein.

TECHNICAL FIELD

The present disclosure generally relates to a refrigerator.

BACKGROUND

A refrigerator is an apparatus keeping foods fresh using cold air generated by a refrigeration cycle. For example, a refrigerator may include a compressor, a condenser, an expansion valve, and an evaporator.

SUMMARY

In general, one innovative aspect of the subject matter described in this specification can be embodied in a refrigerator that includes a cabinet; a storage compartment located within the cabinet; a first door pivotally mounted to the cabinet, the first door configured to open or close a first portion of the storage compartment; a second door pivotally mounted to the cabinet, the second door configured to open or close a second portion of the storage compartment; a pillar pivotally mounted to the first door and configured to block leakage of cold air between the first door and the second door; a pillar boss protruding outward from the pillar; a guide recess configured to guide the pillar boss; and a rotator that defines the guide recess, the rotator being configured to rotate about a rotation axis.

The foregoing and other embodiments can each optionally include one or more of the following features, alone or in combination. In particular, one embodiment includes all the following features in combination. The guide recess includes an insertion portion configured to receive the pillar boss; a first slope coupled to the insertion portion, the first slope having a convex shape; and a second slope coupled to the insertion portion, the second slope having a concave shape. The rotator is configured to rotate in a first direction based on closing force of the second door. The refrigerator further includes a protruding member protruding from the rotator, wherein the protruding member is configured to contact the second door and the rotator is configured to rotate in the first direction based on the closing force of the second door. The second slope is configured to guide the pillar boss and the pillar is configured to be unfolded based on a first rotation of the rotator in the first direction. The refrigerator further includes an elastic member coupled to the rotator and configured to rotate the rotator in a second direction based on elastic force of the elastic member. The refrigerator further includes a first guide configured to guide the elastic member, the elastic member being fitted to the first guide; a second guide configured to guide the first guide; an expanded portion coupled to one end of the first guide, a diameter of the expanded portion being larger than a diameter of the first guide; and a through-hole in the second guide, the through-hole being configured to fit the other end of the first guide, wherein the expanded portion is connected to the rotator. The first slope is configured to guide the pillar boss and the pillar is configured to be folded based on a second rotation of the rotator in the second direction. The elastic force of the elastic member is configured to be smaller than the closing force of the second door. The pillar includes a pillar spring configured to retain a position of the pillar, and wherein the elastic force of the elastic member is configured to be larger than inertia force of the pillar spring. The pillar boss is configured to, based on opening force of the first door, slide on the first slope and exit the insertion portion, and the pillar is configured to be folded after the pillar boss exits the insertion portion. The pillar boss is configured to, based on closing force of the first door, enter the insertion portion and inwardly slide on the second slope, and the pillar is configured to be unfolded based on the pillar boss sliding on the second slope. The elastic member includes two elastic member units and the first guide includes two first guide units, and the protruding member is located between the two elastic member units. The elastic member is spaced apart from the rotation axis in relation to the rotator.

In general, another innovative aspect of the subject matter described in this specification can be embodied in a refrigerator that includes a cabinet; a storage compartment located within the cabinet; a first door pivotally mounted to the cabinet, the first door configured to open or close a first portion of the storage compartment; a second door pivotally mounted to the cabinet, the second door configured to open or close a second portion of the storage compartment; a pillar rotatably mounted to the first door and configured to seal a gap between the first door and the second door; a rotator rotatably mounted to a ceiling of the storage compartment, the rotator rotating in a first direction based on closing force of the second door; and an elastic member configured to rotate the rotator in a second direction based on elastic force of the elastic member, wherein the pillar is configured to be unfolded based on a first rotation of the rotator in the first direction, and is configured to be folded based on a second rotation of the rotator in the second direction.

The foregoing and other embodiments can each optionally include one or more of the following features, alone or in combination. In particular, one embodiment includes all the following features in combination. The refrigerator further includes a pillar boss protruding outward from the pillar; and a guide recess that is coupled to the rotator and that is configured to guide the pillar boss. The guide recess includes: an insertion portion configured to receive the pillar boss; a first slope, having a convex shape, configured to guide the pillar boss being removed from the insertion portion; and a second slope, having a concave shape, configured to guide the pillar boss being inserted into the insertion portion. The guide recess rotates in the second direction and the first slope is configured to rotate the pillar boss in the first direction based on opening force of the second door. The guide recess rotates in the first direction and the second slope is configured to rotate the pillar boss in the second direction based on closing force of the second door. The rotator is configured to rotate in the first direction to a maximum extent and remain static after the second door is closed.

Particular embodiments of the subject matter described in this specification can be implemented so as to realize one or more of the following advantages. Compared to a conventional refrigerator, a refrigerator prevents interference between a pillar and a vegetable box or a door basket by folding the pillar when a door is opened. Thus, the refrigerator is more usable and has more storage capacity when the door is opened.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
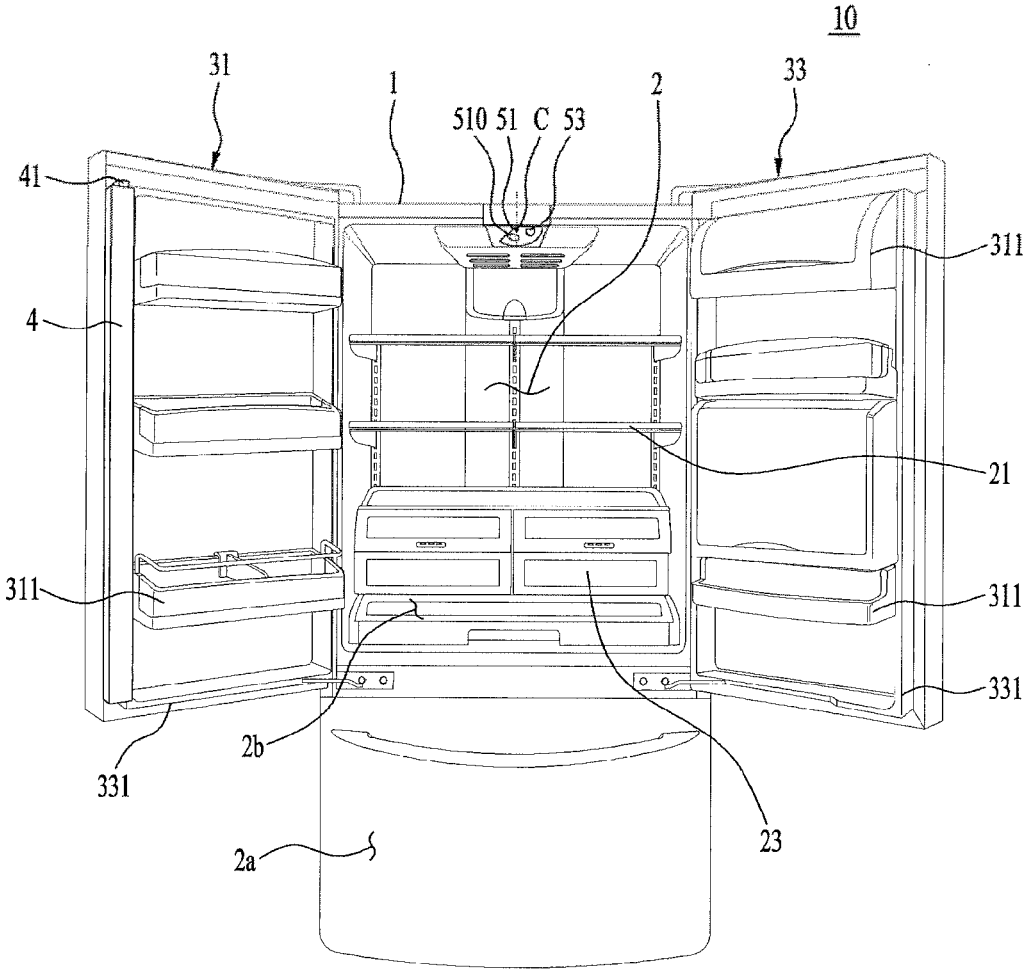
FIG. 1 is a diagram illustrating an example refrigerator.

FIG. 1 illustrates an example refrigerator. The refrigerator 10 may include a cabinet 1 defining an external appearance of the refrigerator 10, a storage compartment 2 defined inside the cabinet 1, a first door 31 and a second door 32 pivotally provided respectively at the left and right sides of the cabinet 1 in order to open or close the storage compartment 2, a pillar 4 provided at the first door 31, a pillar boss 41 formed on the top of the pillar 4, and a rotator 51 having a guide recess 510 configured to guide the pillar boss 41.

The refrigerator 10 includes the pillar 4. The pillar 4 is unfolded to seal a gap between the doors 31 and 33 in a state in which both the doors 31 and 33 are closed, and the pillar 4 is folded in a state in which at least one of the doors 31 and 33 is opened.

The storage compartment 2 represents a space in which storage items may be stored. In some implementations, the storage compartment 2 may include a freezing compartment in which storage items are stored at a temperature below the freezing point, and a refrigerating compartment in which storage items are stored at a temperature above the freezing point.

The storage compartment 2 may include a shelf 21 on which the storage items may be placed, and a vegetable box 23 which is configured to receive storage items therein and to be pulled out of the storage compartment 2.

The doors 31 and 33 may prevent the leakage of cold air supplied into the storage compartment 2. The doors 31 and 33 may include the first door 31, which is hinged to the left side of the cabinet 1 and is pivotable, and the second door 33 which is hinged to the right side of the cabinet 1 and is pivotable.

Each of the first door 31 and the second door 33 may be provided at a rear surface thereof with a door basket 311 so as to receive storage items therein.

In addition, a gasket 331 is provided at the periphery of the rear surface of each of the first door 31 and the second door 33, and prevents cold air from being discharged between the doors 31 and 33 and the cabinet 1.

In some implementations, the pillar 4 can be coupled to the first door 31. In some other implementations, the pillar 4 can be coupled to the second door 3. Other components may correspondingly be provided and operated in the opposite configuration.

Figure 2:
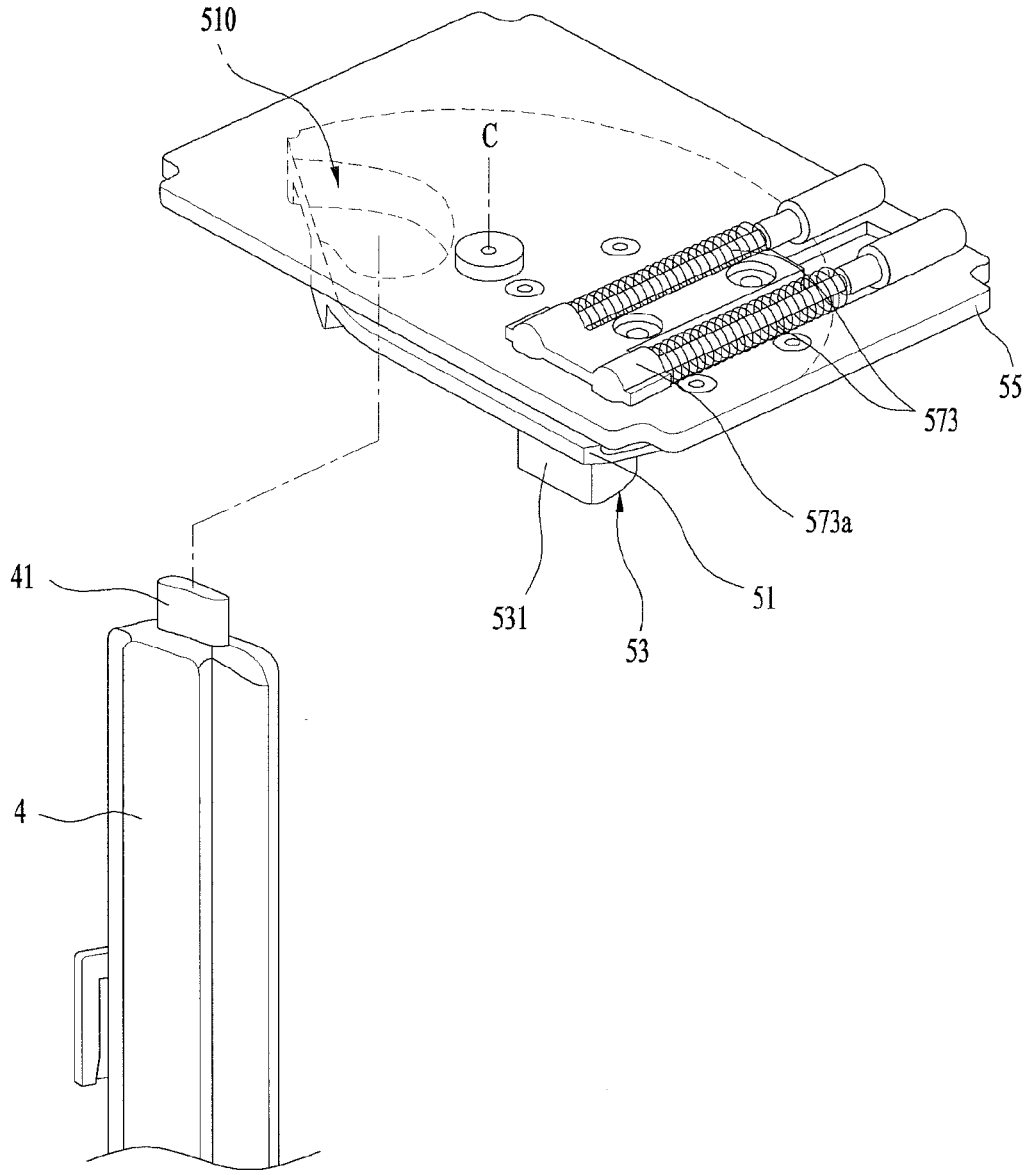
FIG. 2 is a diagram illustrating an example pillar, an example protruding member, an example rotator, and an example housing.

Referring to FIG. 2, the pillar 4 takes the form of an elongated bar. That is, the pillar 4 is long in the vertical direction and wide in the horizontal direction. The pillar 4 may incorporate a pillar spring therein, and the elastic force of the pillar spring becomes minimum force that must be supplied to the pillar 4 configured to allow the pillar 4 to be folded or unfolded.

In some implementations, a first angle can be set. The first angle represents an angular range to cause the pillar 4 to be changed between a folded state and an unfolded state. Thus, when external force is applied to exceed the first angle and the pillar 4 is in the unfolded state, the pillar 4 is folded. Contrary, when external force is applied to exceed the first angle and the pillar 4 is in the folded state, the pillar 4 is unfolded.

Although the pillar boss 41 may have a circular pole shape, the pillar boss 41 may have an oval pole shape in order to increase the radius of curvature.

The pillar boss 41 protrudes from the top of the pillar 4. The pillar 4 incorporates a pillar boss spring therein to support the pillar boss 41 such that the pillar boss 41 is movable up and down.

Accordingly, it is possible to prevent the pillar boss 41 from being damaged while being guided to the guide recess 510.

Figure 3:
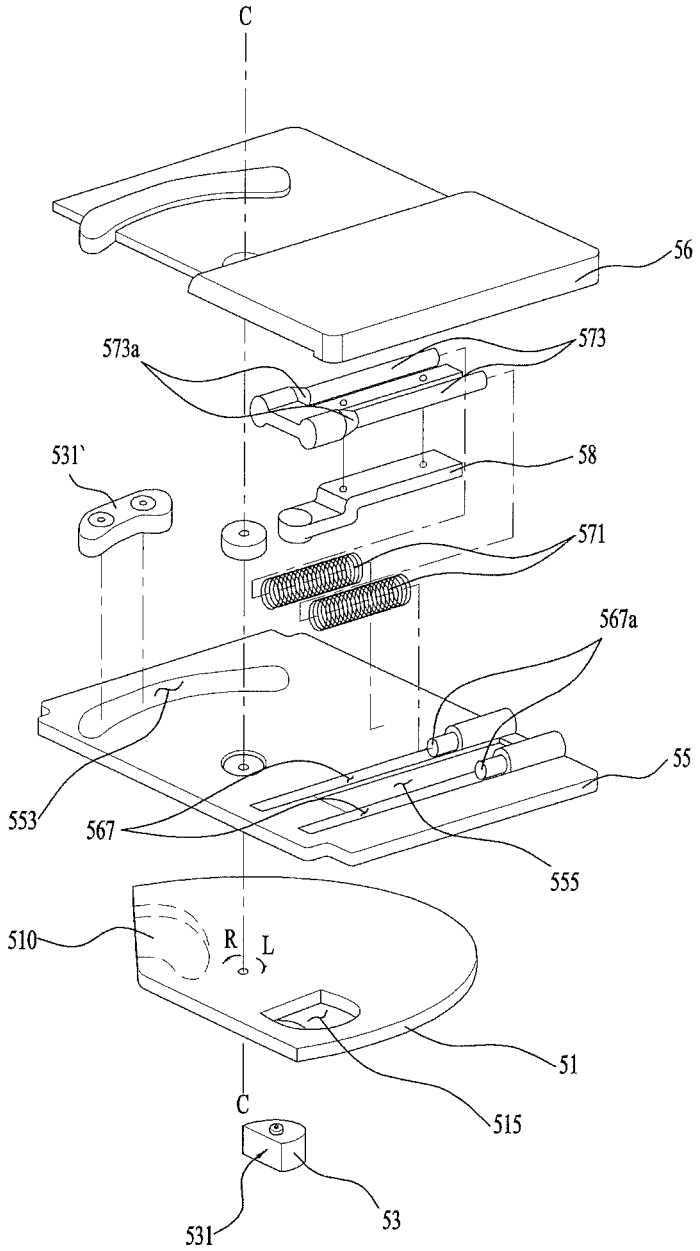
FIG. 3 is a diagram illustrating an example protruding member, an example rotator, and an example housing.
Figure 4:
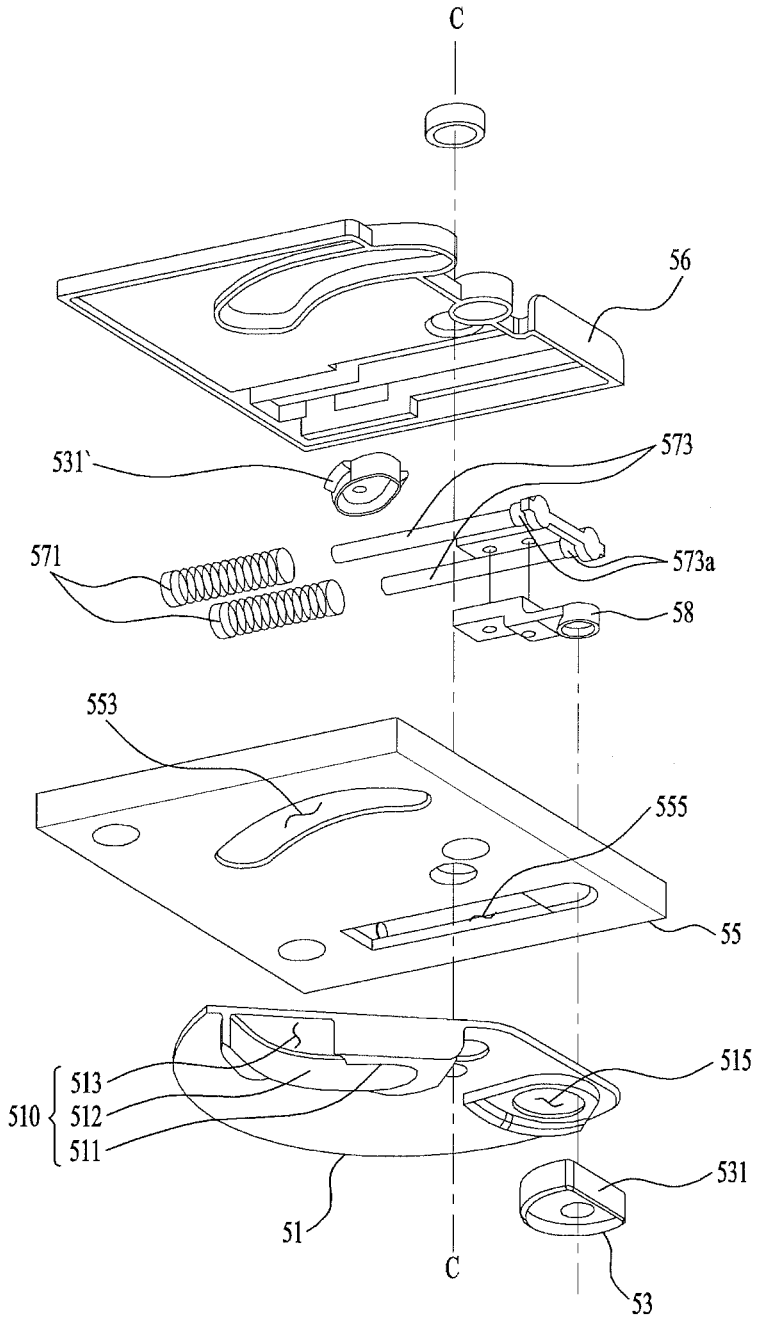
FIG. 4 is a diagram illustrating an example protruding member, an example rotator, and an example housing.

Referring to FIGS. 3 and 4, the guide recess 510 has a prescribed space configured to guide the pillar boss 41.

The guide recess 510 includes an insertion portion 513 which is open for the insertion of the pillar boss 41, a first slope 511 which is connected to the insertion portion 513 and is located close to the doors 31 and 33, the first slope 51 being convex rearward, and a second slope 512 which is connected to the insertion portion 513 and is located far from the doors 31 and 33, the second slope 512 being concave forward.

In some implementations, the guide recess 510 may include the insertion portion 513 which is open to allow the insertion and removal of the pillar boss 41, the first slope 511 which is configured to guide the pillar boss 41 when the pillar boss 41 is removed from the insertion portion 513, and the second slope 512 which is configured to guide the pillar boss 41 when the pillar boss 41 is inserted into the insertion portion 513.

The prescribed space is defined between the first slope 511 and the second slope 512 so as to guide the pillar boss 41. The first slope 511 is convex and the second slope 512 is concave.

The insertion portion 513 is wider than the pillar boss 41. This prevents the pillar boss 41 from being damaged by colliding with the periphery of the insertion portion 513 when the pillar boss 41 is inserted into the insertion portion 513 due to the assembly tolerance of the doors 31 and 33 and the assembly tolerance of the pillar 4.

The rotator 51 includes the guide recess 510, and is provided below housings 55 and 56, as will be described below, which are installed at the ceiling of the storage compartment 2, so as to be rotatable about the rotation axis C. Since the housings 55 and 56 are not essential to the present invention, the rotator 51 may be rotatably provided at the ceiling of the storage compartment 2. In addition, the guide recess 510 may be formed in an inner case of the storage compartment 2.

In addition, the rotator 51 may take the form of a fan-shaped plate. In this example, a straight portion of the fan-shaped rotator 51 is configured so as not to protrude forward from a top surface of the storage compartment 2 even if the rotator 51 is rotated, thus having no risk of interference with the doors 31 and 33.

The storage compartment 2 may have a concavely stepped fixing portion at the ceiling thereof, and the rotator 51 and the housings 55 and 56 may be provided at the fixing portion. In this example, the rotator 51 and the housings 55 and 56 may be placed on the same plane as the top surface of the storage compartment 2.

As definitions related to rotation directions, when viewing the rotator 51 from the top side, the counterclockwise direction or the right-handed screw direction is referred to as a first direction R, and the clockwise direction or the left-handed screw direction is referred to as a second direction L. The first direction R and the second direction L are applied not only to the rotation of the rotator 51, but also to the rotation of the pillar 4.

In some implementations, the refrigerator 10 may further include a protruding member 53 connected to the rotator 51 and an elastic member 571 connected to the rotator 51.

The protruding member 53 is configured to protrude downward from the rotator 51. There is the rotation axis C between the guide recess 510 and the protruding member 53. That is, in one embodiment of the present invention, when viewing the rotator 51 from the top side, the guide recess 510 is located at the left side of the rotator 51 and the protruding member 53 is located at the right side of the rotator 51.

In addition, the protruding member 53 may be spaced apart from the rotation axis C to the maximum extent, so as to allow more torque to be applied when force is supplied in order to rotate the rotator 51.

Accordingly, the protruding member 53 comes into contact with the second door 33 when the second door 33 is closed, and is pushed rearward by the closing force of the second door 33, thereby rotating the rotator 51 in the first direction R.

In this example, the protruding member 53 may be in contact with a pusher which protrudes from the rear surface of the second door 33, or may be in contact with the door basket 311 provided at the rear surface of the second door 33.

The protruding member 53 may be rotatably provided in a protruding member fitting hole 515 formed in the rotator 51. In some implementations, the protruding member 53 may be integrally formed at the underside of the rotator 51.

In some other implementations, the elastic member 571 provides elastic force required to allow the rotator 51 to be rotated in the second direction L.

The elastic member 571 may include a spring.

The rotation axis C may be present between the guide recess 510 and the elastic member 571. That is, the elastic member 571 is located at the right side of the rotator 51.

In this example, the elastic member 571 is compressed when the rotator 51 is rotated in the first direction R, and returns to an original state thereof when the rotator 51 is rotated in the second direction L. That is, the rotator 51 is rotated in the second direction L using the compressive elastic force of the elastic member 571.

In some implementations, in order to enhance the operation ability of the elastic member 571, the refrigerator 10 may further include the housings 55 and 56 installed at the ceiling of the storage compartment 2, and guides 573 and 567 for the elastic member 571 provided inside the housings 55 and 56.

The housings 55 and 56 include the upper housing 56 and the lower housing 56. The rotator 51 is provided on a lower surface of the lower housing 55 so as to be rotatable about the rotation axis C.

The guides 573 and 567 are provided inside the housings 55 and 56, and include the first guide 573 into which the elastic member 571 is fitted, and the second guide 567 formed in the lower housing 55 in order to guide the first guide 573.

The second guide 567 has a through-hole **567*a* into which one end of the first guide 573** is fitted so as to be guided.

The first guide 573 is coupled to an expanded portion **573*a*. For example, one end of the first guide 573 can be coupled to the expanded portion 573*a*. The expanded portion 573*a* may have a greater diameter than the first guide 573 so as to prevent the elastic member 571 from being removed from the first guide 573**.

As such, the elastic member 571 fits the first guide 573, and in turn, the first guide 573 fits the through-hole **567*a* so as to be guided in the front-and-rear direction. With this guidance, the elastic member 571 is compressed between the expanded portion 573*a* and the through-hole 567*a***.

In some implementations, in order to enhance the elastic force of the elastic member 571, the elastic member 571 may include two elastic member units. Thus, in order to guide the two respective elastic member units, two first guide units, two expanded portions, two second guides, and two through-holes may be provided.

In this example, the two expanded portions **573*a* may be integrally formed with each other, which allow the two elastic members 571** to be moved in the same manner.

In some implementations, where the elastic members 571 and the guides 573 and 567 are provided inside the housings 55 and 56, the refrigerator 10 may further include a linkage member 58 configured to connect the expanded portions **573*a* and the rotator 51 to each other, and a third guide 555 formed in the lower housing 55 to enable the movement of the linkage member 58**.

As such, the elastic force of the elastic members 571 may be transmitted to the rotator 51 so as to rotate the rotator 51.

The third guide 555 takes the form of an elongated rectangular hole having a prescribed length in the front-and-rear direction, the third guide 555 being perforated in the lower surface of the lower housing 55 and serving to allow the linkage member 58 to be linearly moved in the front-and-rear direction.

In addition, in one embodiment of the present invention, as the protruding member 53 and the linkage member 58 are directly connected to each other using the same shaft, forces to rotate the rotator 51 in different directions are present on the same shaft.

As such, when the rotator 51 is rotated, unsmooth rotation, for example, rattling of the rotator 51, which is caused by opposite forces applied at different distances from the rotation axis C, may hardly occur.

In this example, the protruding member fitting hole 515 must be perforated in the rotator 51 so as to have a prescribed area, in order to ensure that the rotating shaft of the protruding member 53 connected to the rotator 51 is movable inside the protruding member fitting hole 515. This is because the linkage member 58 is linearly moved in the front-and-rear direction by the third guide 555 and the protruding member 53 connected to the rotator 51 is rotated, which causes the protruding member 53 and the linkage member 58 to conflict with each other when connected using the same shaft.

Accordingly, as the rotating shaft of the protruding member 53 is movable in the protruding member fitting hole 515, the protruding member 53 is also linearly movable in the front-and-rear direction.

In addition, the lower housing 55 may have a fourth guide 553 perforated therein in order to prevent the rotator 51 from falling down from the housings 55 and 56 and to guide the rotation of the rotator 51, and the rotator 51 may further include a support piece 513' which is connected to the rotator 51 through the fourth guide 553 so as to be guided by the fourth guide 553.

In the refrigerator 10, the protruding member 53 may include a flat contact portion 531 configured to have the surface in contact with the second door 33 or the pusher.

That is, the protruding member 53 may have a semicircular pole shape, and the contact portion 531 may be formed as a flat surface formed at the diameter of a semicircle.

The contact portion 531 may incorporate a first magnet therein, and a second magnet may be incorporated inside the pusher. The first magnet and the second magnet have different polarities so as to be attracted to each other.

As such, when the second door 33 is opened, the protruding member 53 is pulled, by the pusher, in the direction in which the second door 33 is opened, and correspondingly, the rotator 51 is rotated in the second direction L.

Through provision of the guide recess 510, the pillar 4 is operated so as to be unfolded when the pillar boss 41 is inserted into the guide recess 510, and is operated so as to be folded when the pillar boss 41 is removed from the guide recess 510.

Figure 5:
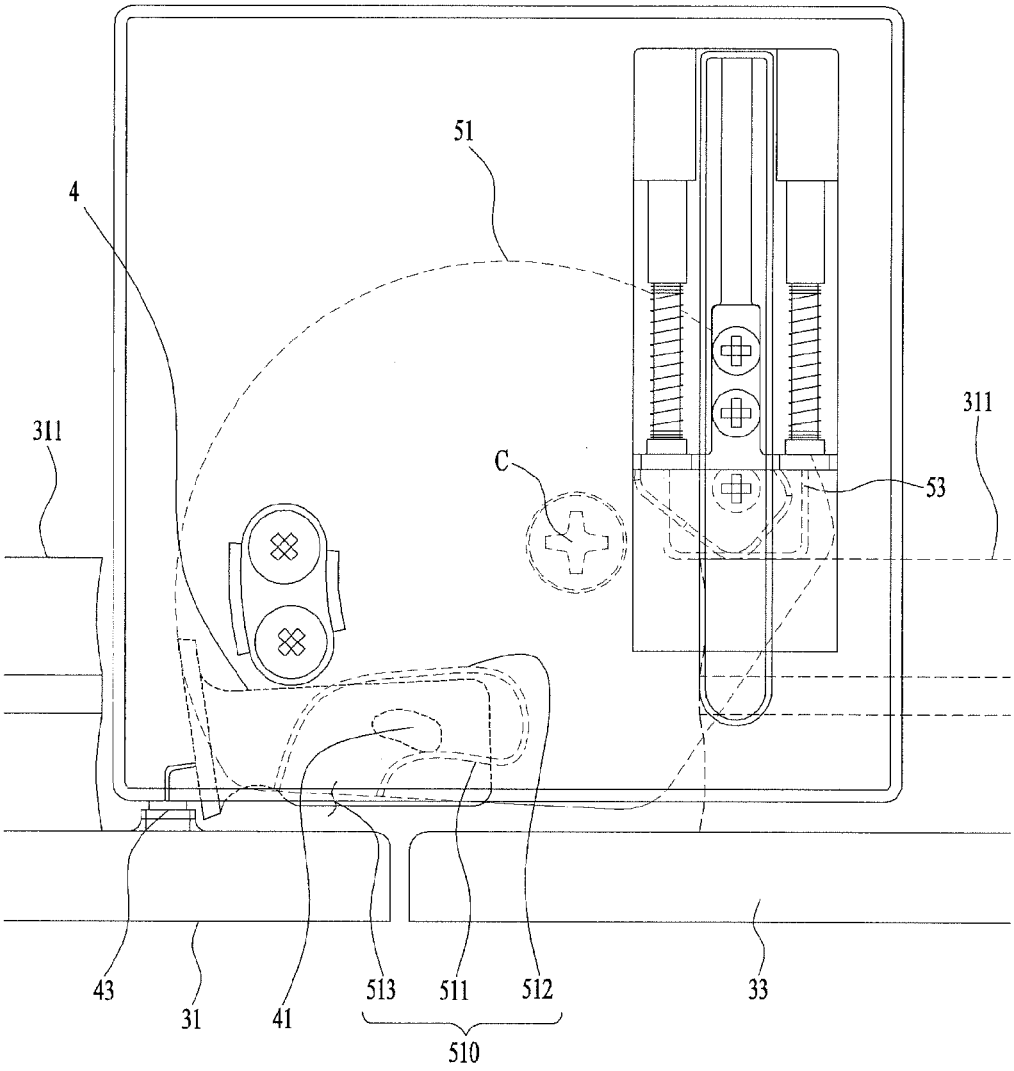
FIG. 5 is a diagram illustrating an example state representing that a first door and a second door are closed.
Figure 6:
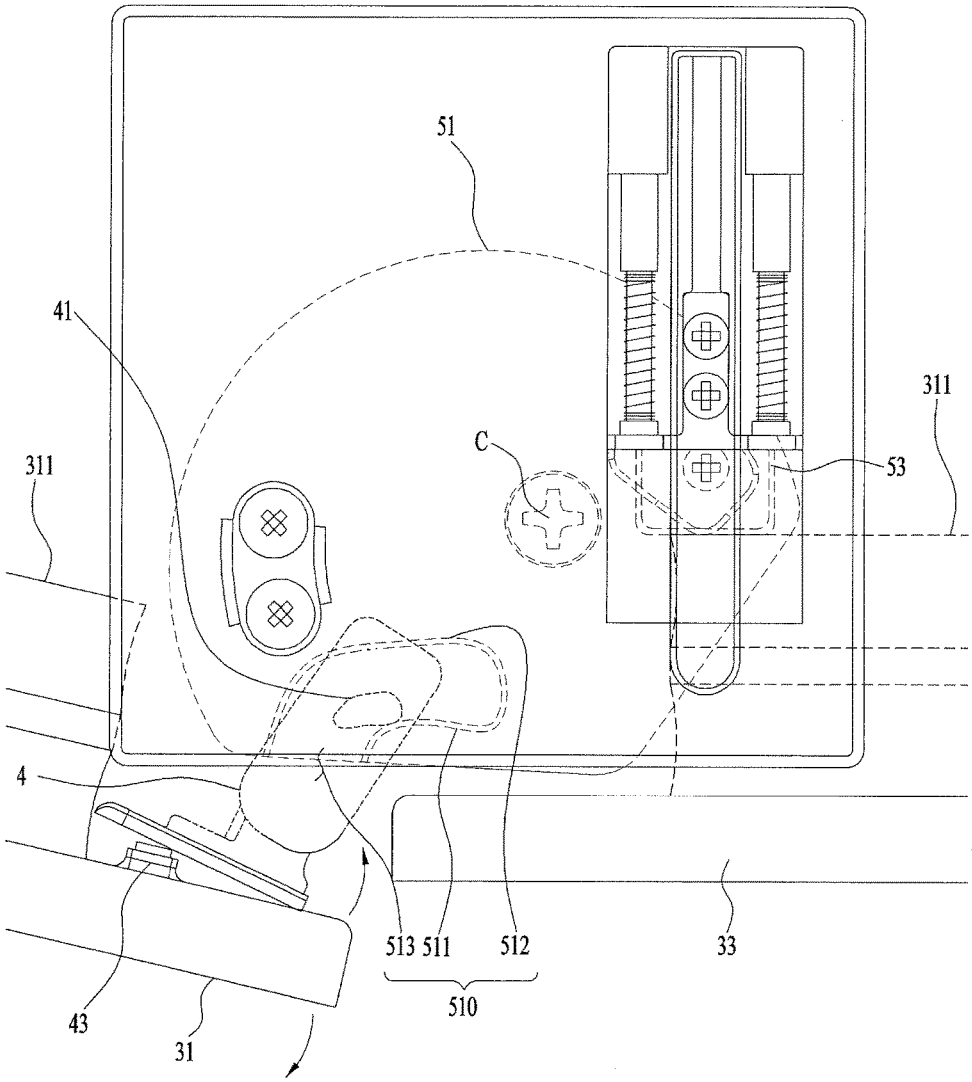
FIG. 6 is a diagram illustrating an example state representing that a first door is being opened.
Figure 7:
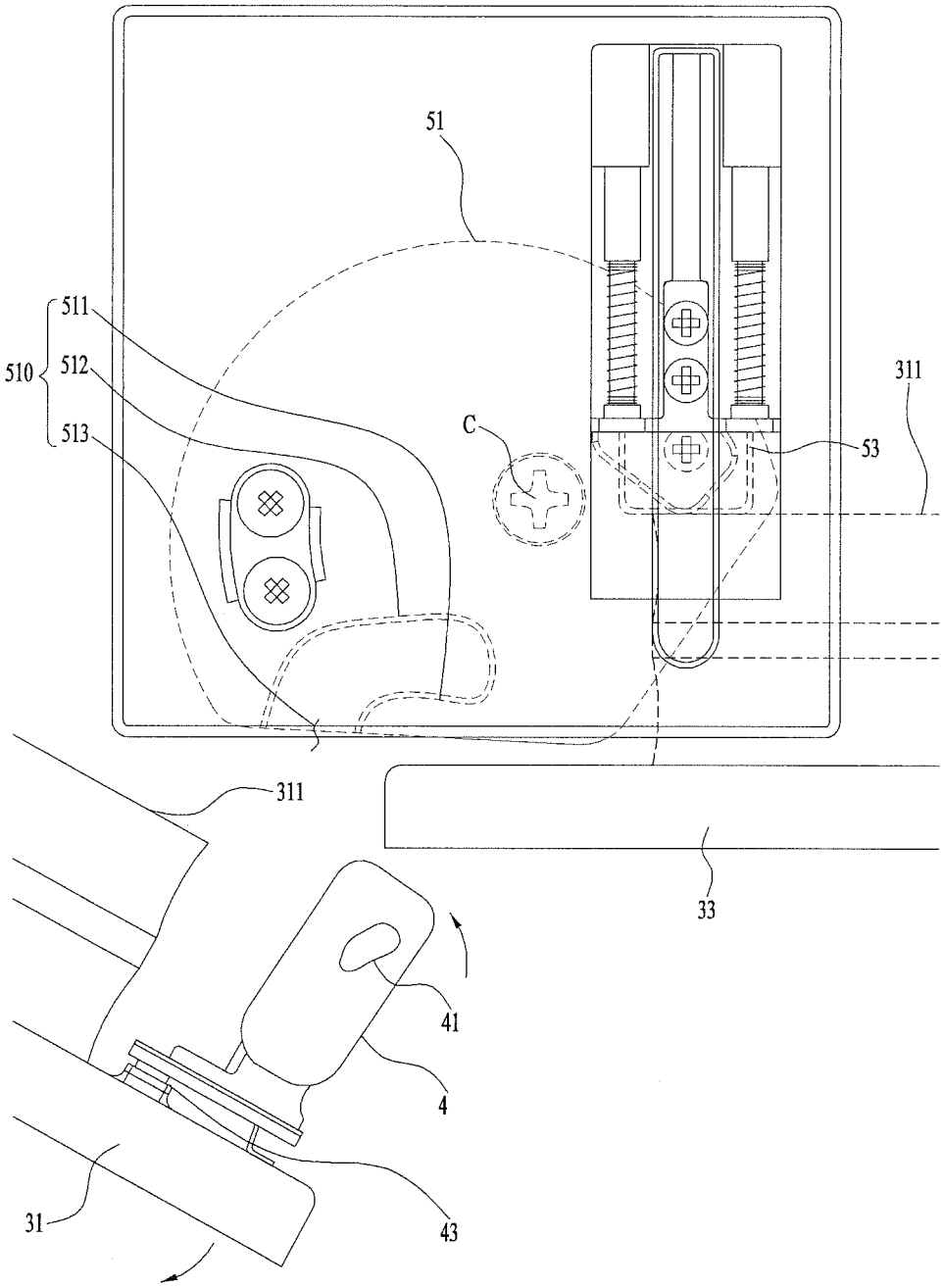
FIG. 7 is a diagram illustrating an example representing state that a first door is completely opened.

FIG. 5 illustrates an example state representing that a first door and a second door are closed. FIG. 6 illustrates an example state representing that a first door is being opened. FIG. 7 illustrates an example representing state that a first door is completely opened. The folding and unfolding operations of the pillar 4 upon the opening and closing of the first door 31 and the second door 33 will be described with reference to FIGS. 5-7.

First, a folding configuration of the pillar 4 when the first door 31 is opened and an unfolding configuration of the pillar 4 when the first door 31 is closed will be described.

Referring to FIG. 5, in a state in which the second door 33 is closed, the protrusion 53 is moved rearward to the maximum extent by the second door 33, and the rotator 51 is static in a state in which it is rotated in the first direction R to the maximum extent. In addition, as described above, the guide recess 510 is located at the left side of the rotator 51.

In this example, the first door 31 is being opened. As the first door 31 is being opened, the pillar boss 41 slides on the first slope 511 (see FIG. 6) and passes through the insertion portion 513, thereby being removed from the guide recess 510 (see FIG. 7).

Since the first slope 511 is convex rearward, the pillar boss 41 is rotated in the first direction R, and larger force than the elastic force of the pillar spring provided inside the pillar 4 is applied to the pillar boss 41, thus causing the pillar 4 to be folded. That is, folding torque applied to the pillar boss 41 by the first slope 511 must be larger than the elastic force of the pillar spring described above.

In some implementations, once the pillar boss 41 has been removed from the insertion portion 513, the pillar 4 is rotated more than the first angle, thereby being folded.

Accordingly, as the pillar 4 is folded as exemplarily illustrated in FIG. 6, when the first door 31 is opened, the pillar 4 hardly collides with the second door 33 or the door basket 311 of the second door 33, and the pillar 4 hardly protrudes from the side surface of the second door 31, which may improve the aesthetic appearance of the refrigerator 10.

Although not illustrated in the drawings, in comparison, the first door 31 can be being closed. As the first door 31 is being closed, the pillar boss 41 is introduced into the insertion portion 513 and comes into contact with the second slope 512 so as to slide on the second slope 512. Thereby, the pillar boss 41 is inserted inside the guide recess 510.

Since the second slope 512 is concave forward, the pillar boss 41 is rotated in the second direction L, and larger force than the elastic force of the pillar spring provided inside the pillar 4 is applied to the pillar boss 41, thus causing the pillar 4 to be unfolded.

That is, the pillar boss 41 receives unfolding torque required to allow the pillar 4 to be unfolded by sliding and rotating on the second slope 512, and the unfolding torque must be larger than the elastic force of the pillar spring described above.

In some implementations, as the pillar 4 is rotated beyond the first angle while the pillar boss 41 is being guided by the second slope 512, the pillar 4 is unfolded.

Accordingly, the pillar 4 is unfolded and seals a gap between the first door 31 and the second door 33 so as to prevent leakage of cold air.

Figure 8:
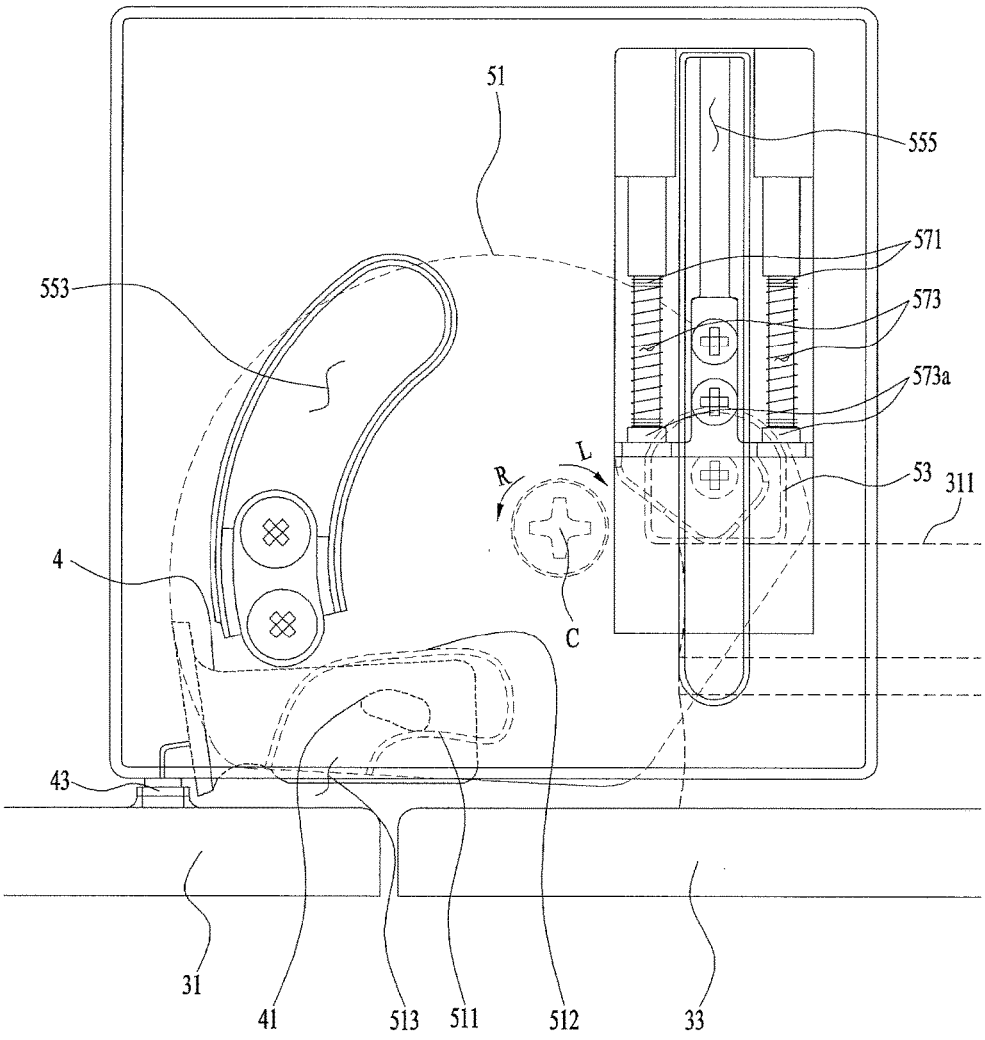
FIG. 8 is a diagram illustrating an example state representing that a first door and a second door are closed.
Figure 9:
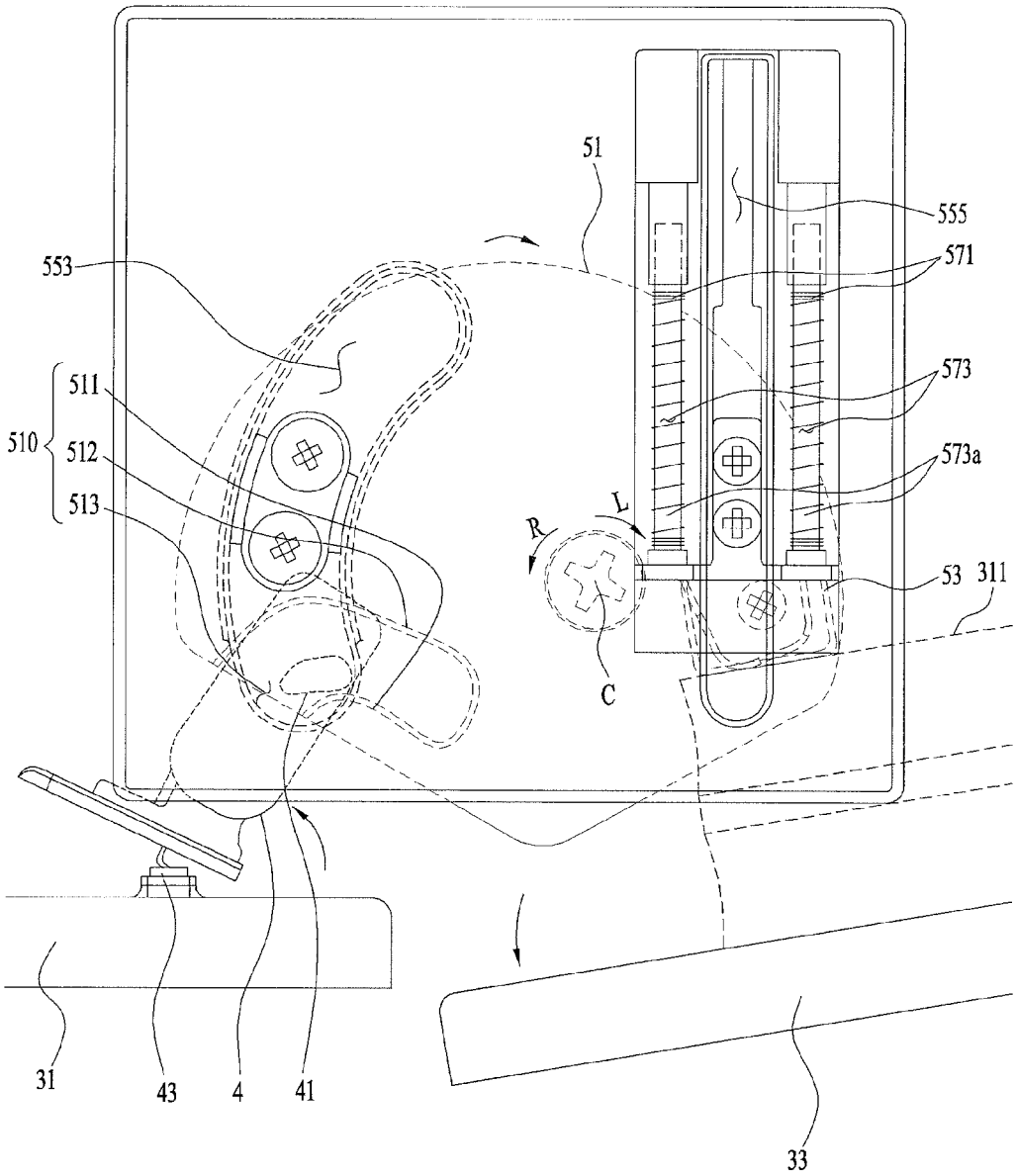
FIG. 9 is a diagram illustrating an example state representing that a second door is being opened.
Figure 10:
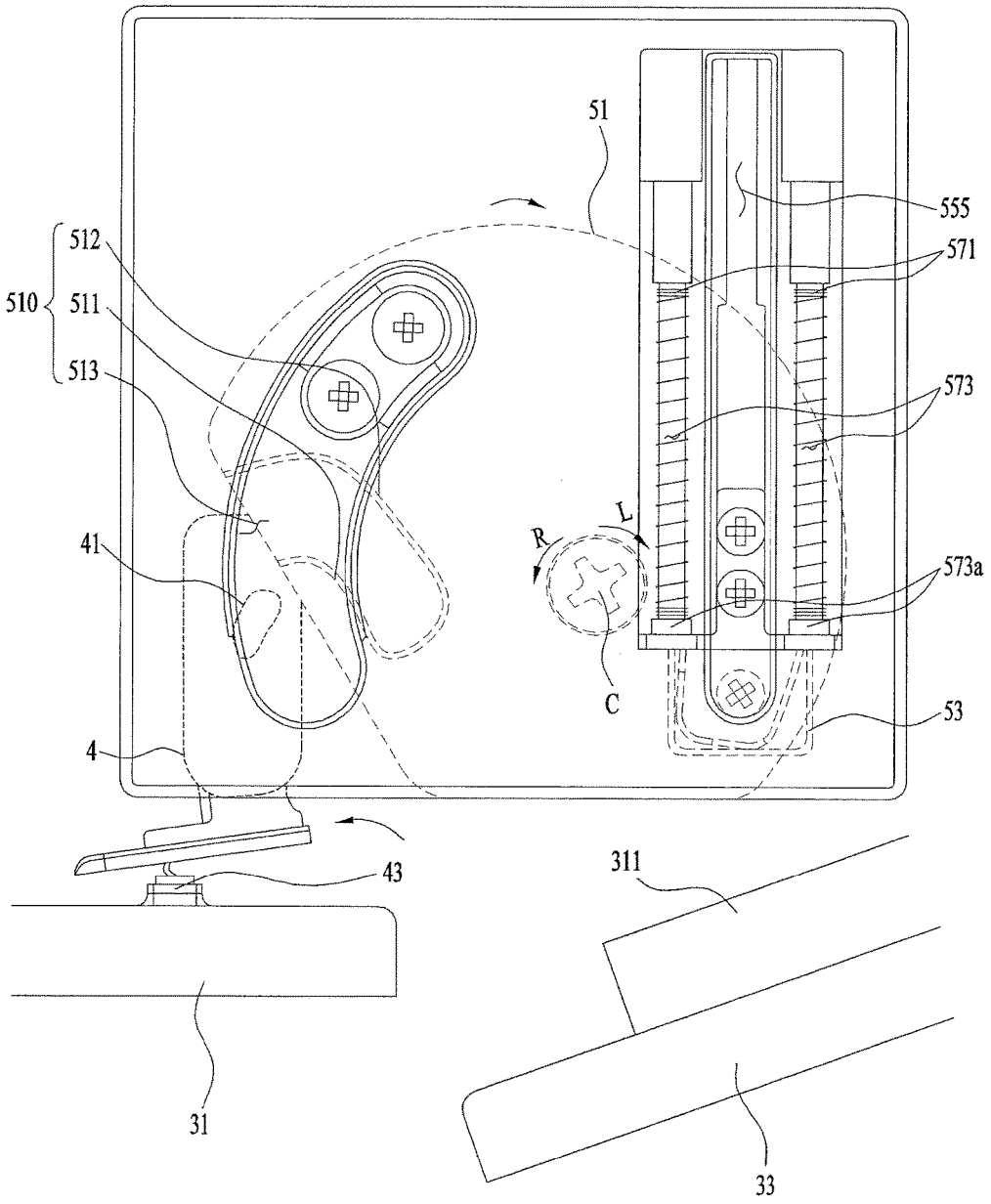
FIG. 10 is a diagram illustrating an example state representing that a second door is opened.

FIG. 8 illustrates an example state representing that a first door and a second door are closed. FIG. 9 illustrates an example state representing that a second door is being opened. FIG. 10 illustrates an example state representing that a second door is opened. A folding configuration of the pillar 4 when the second door 33 is opened will be described with reference to FIGS. 8-10.

Referring to FIG. 8, both the first door 31 and the second door 33 are closed. In such a state, the protruding member 53 is pushed rearward by the second door 33, and the rotator 51 is rotated in the first direction R to the maximum extent.

This is because the closing force of the second door 33 is larger than the elastic force of the elastic member 571. The closing force of the second door 33 may include, for example, the weight of the door 33, the weight of items stored in the door basket 311, and magnetic force of the magnet in the closed state of the door 33.

In this example, the pillar 4 is in the unfolded state, and prevents leakage of cold air between the first door 31 and the second door 33.

As exemplarily illustrated in FIG. 9, when the second door 33 begins to be opened, the closing force of the second door 33 applied to the rotator 51 is removed, and therefore the rotator 51 is rotated in the second direction L by the elastic force of the elastic member 571.

Thereby, the guide recess 510 formed in the rotator 51 is also rotated in the second direction L.

Force is applied to the pillar boss 41 located in the guide recess 510 by the first slope 511 in the direction in which the pillar 4 is rotated (i.e. the first direction R). Since this force is larger than the elastic force of the pillar spring provided inside the pillar 4, the pillar 4 is rotated toward the first door 31.

That is, the elastic force of the elastic member 571 must be larger than the elastic force of the pillar spring of the pillar 4 in order to ensure that the pillar 4 may be folded. Thus, as exemplarily illustrated in FIG. 10, the pillar 4 is folded when the second door 33 is completely opened.

In some implementations, the pillar 4 is rotated beyond the first angle to thereby be folded when the pillar boss 41 is removed from the insertion portion 513.

Since the pillar 4 is in the folded state, the pillar 4 does not cover an opening of the storage compartment 2 that is opened or closed by the second door 33, which allows the vegetable box 23 provided inside the storage compartment 2 to be configured to have a great volume, and may prevent the user from being blocked by the pillar 4 when introducing or retrieving storage items.

Figure 11:
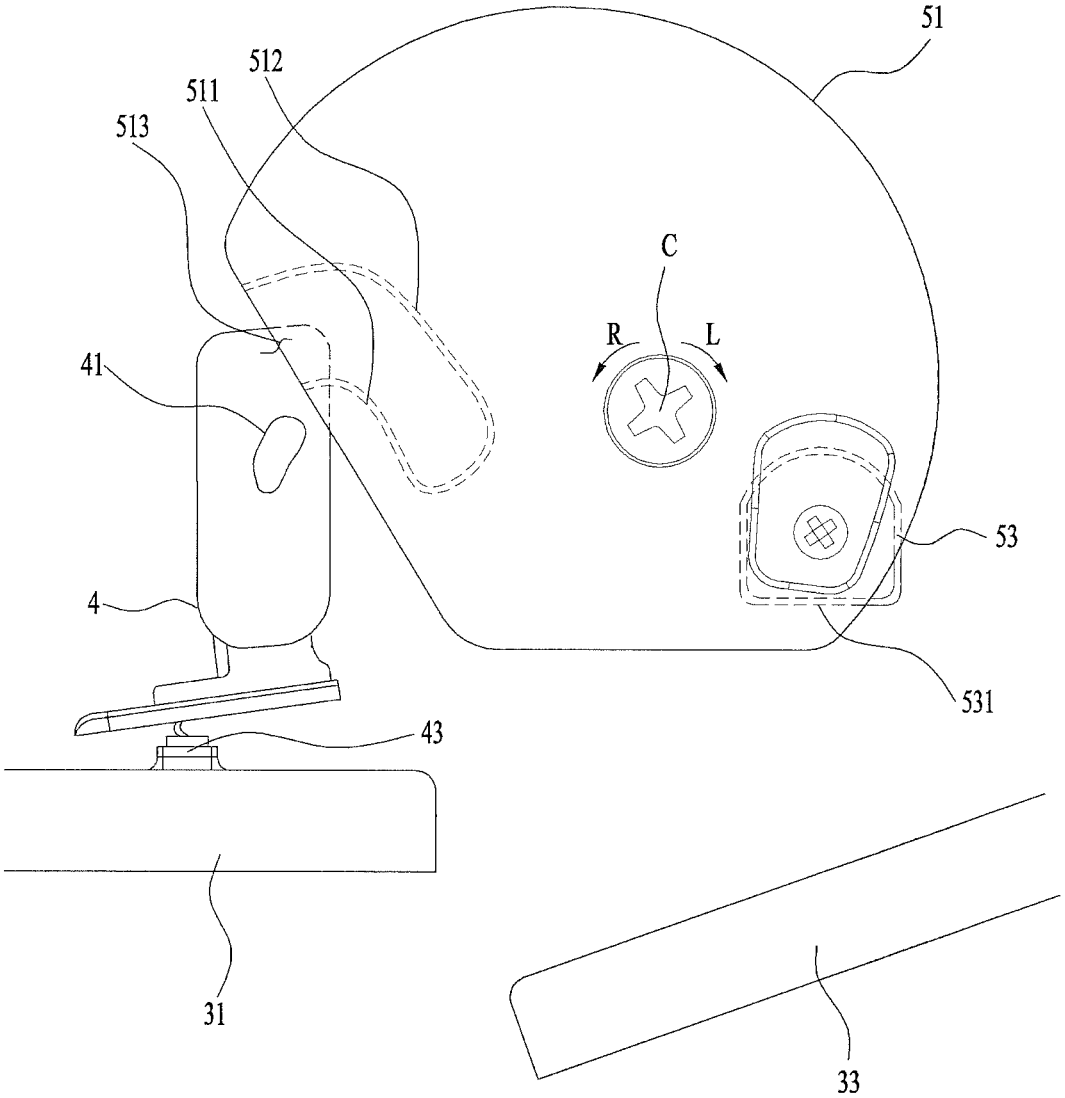
FIG. 11 is a diagram illustrating another example state representing that a second door is opened.
Figure 12:
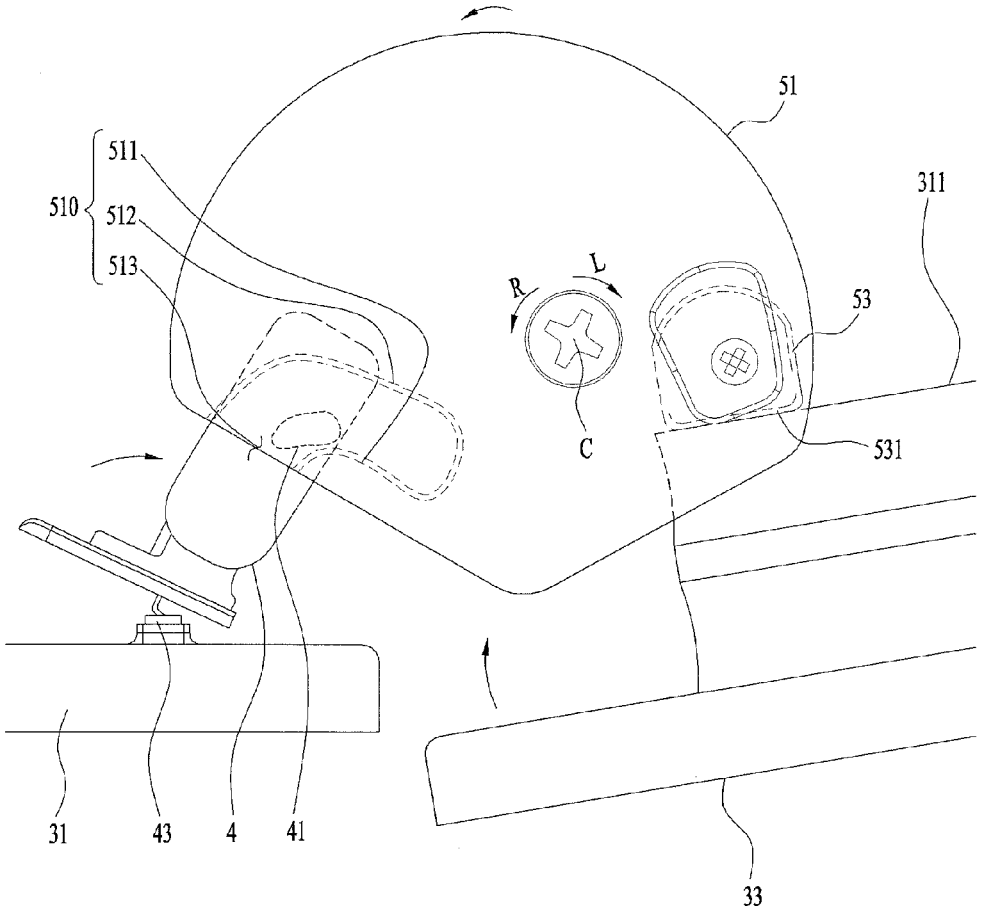
FIG. 12 is a diagram illustrating an example state representing that a second door is being closed.
Figure 13:
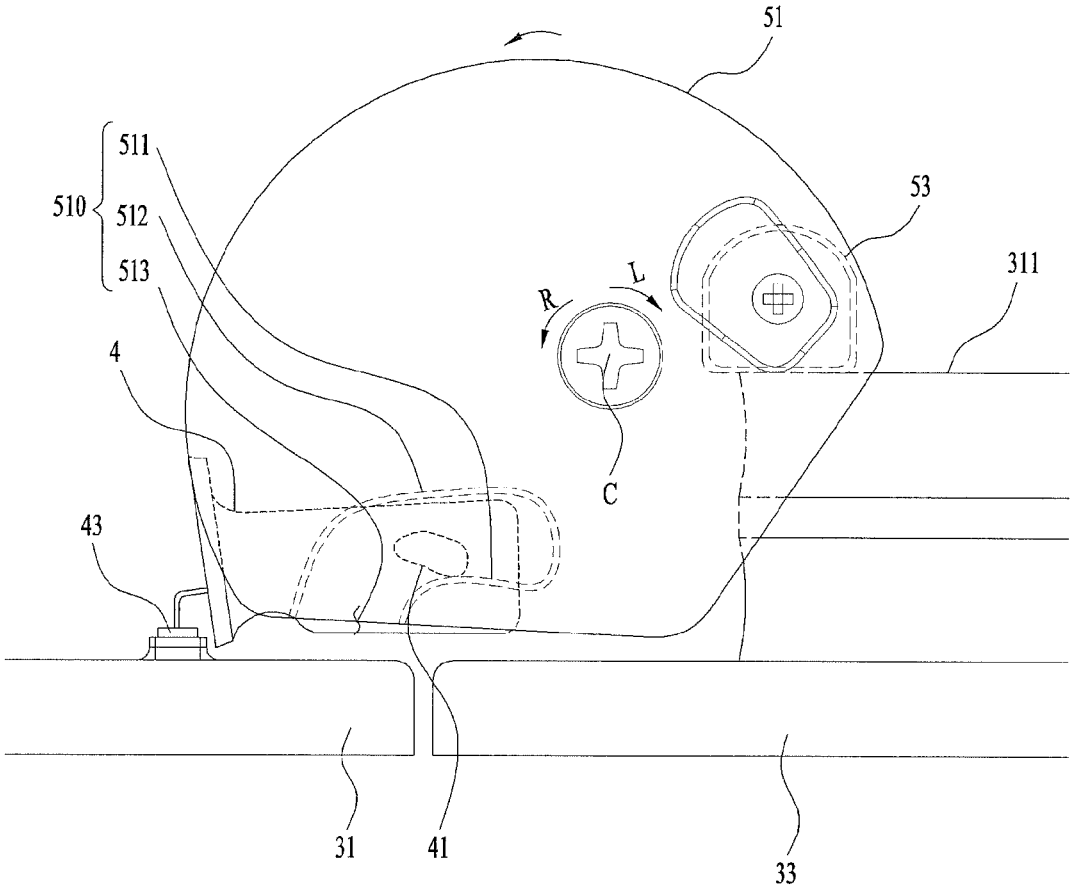
FIG. 13 is a diagram illustrating an example state representing that a second door is closed.
Figure 14:
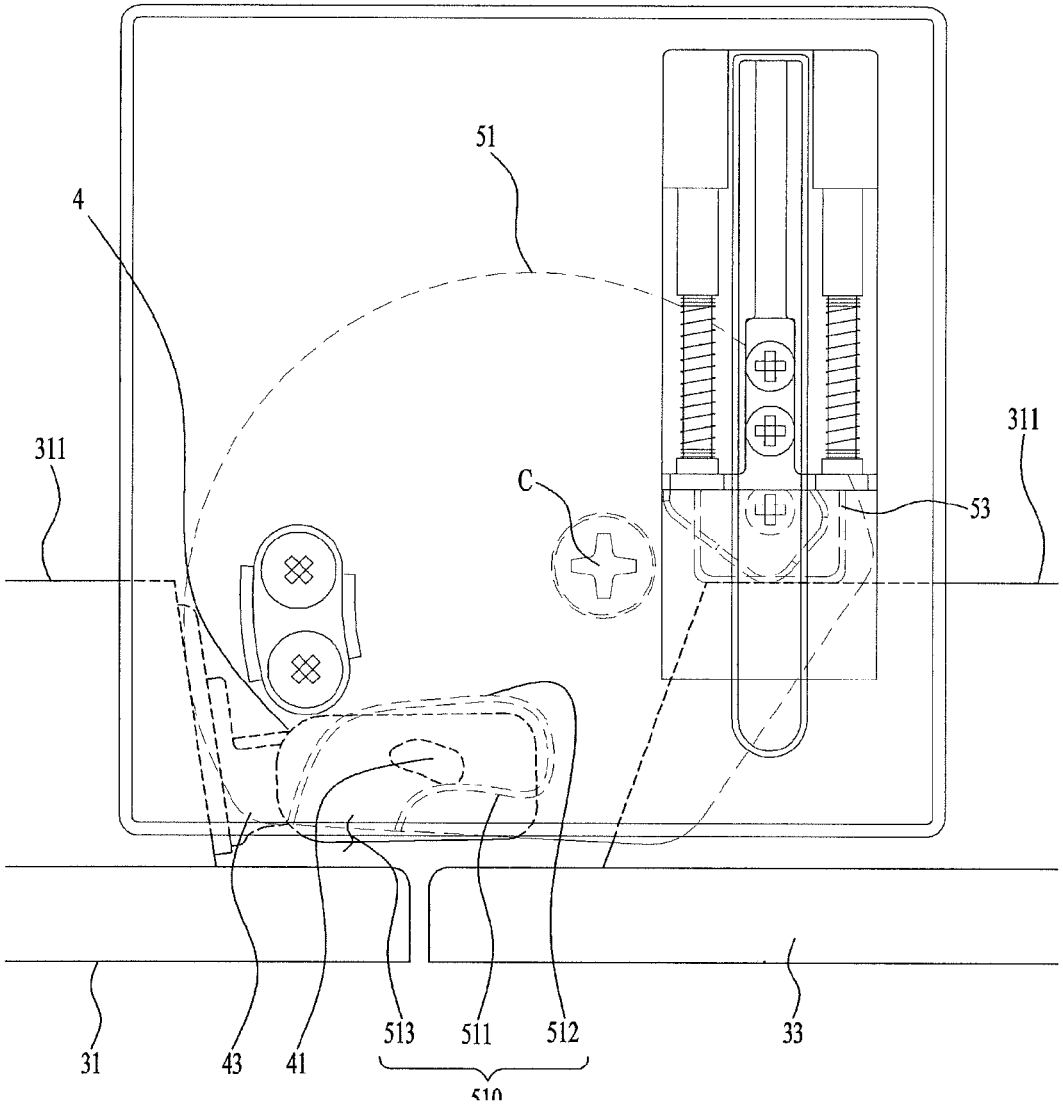
FIG. 14 is a diagram illustrating an example state representing that a first door and a second door are closed.
Figure 15:
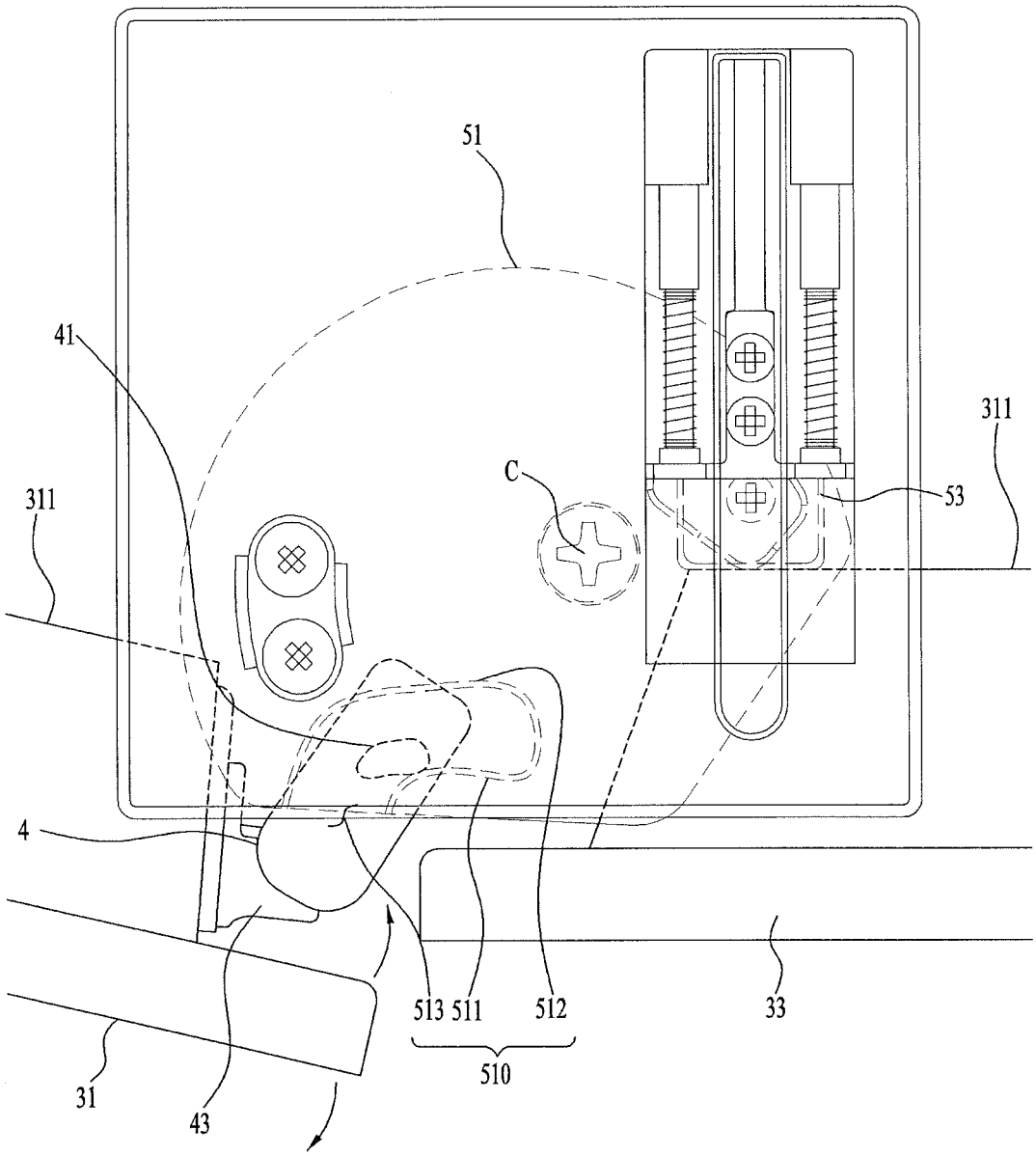
FIG. 15 is a diagram illustrating an example state representing that the first door is being opened.
Figure 16:
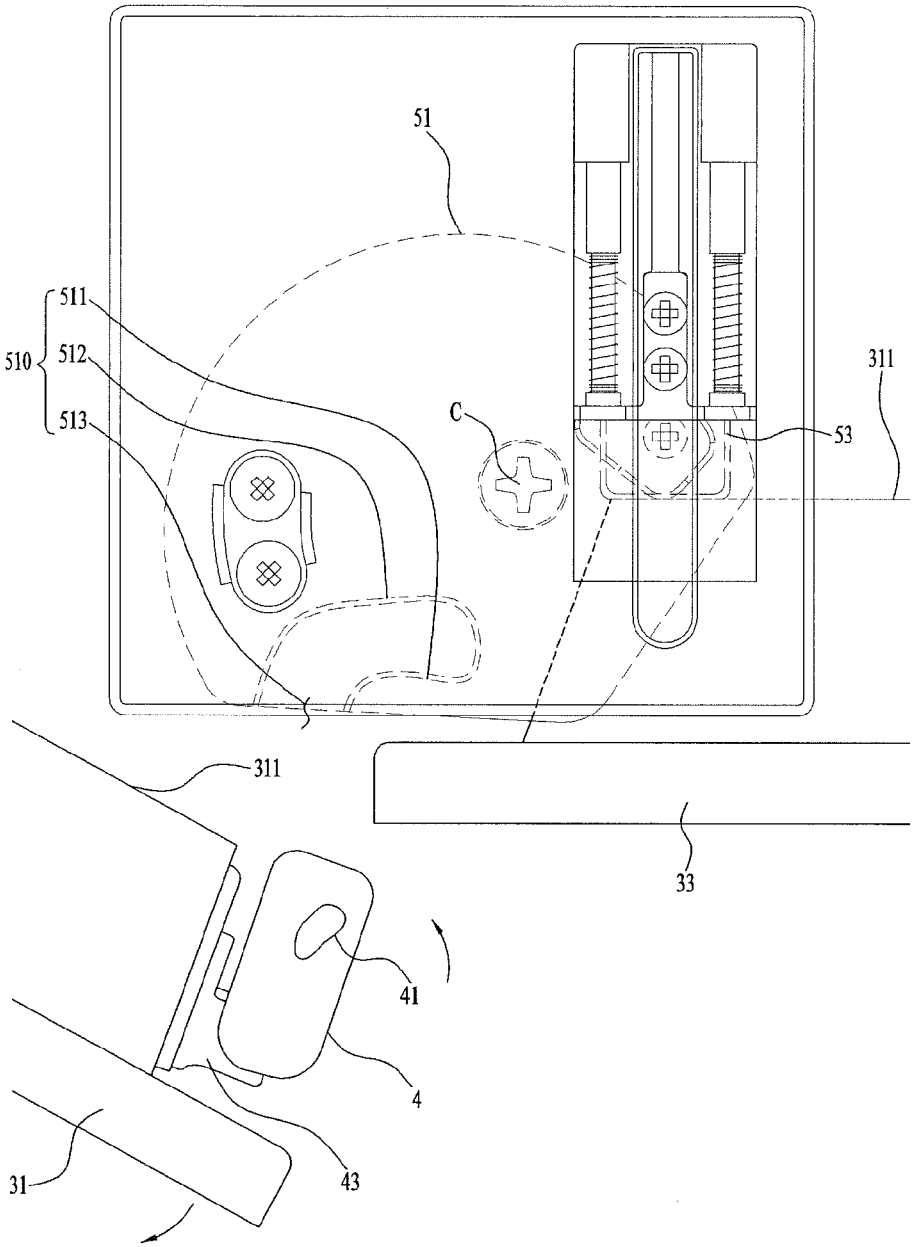
FIG. 16 is a diagram illustrating an example state representing a first door is completely opened.
Figure 17:
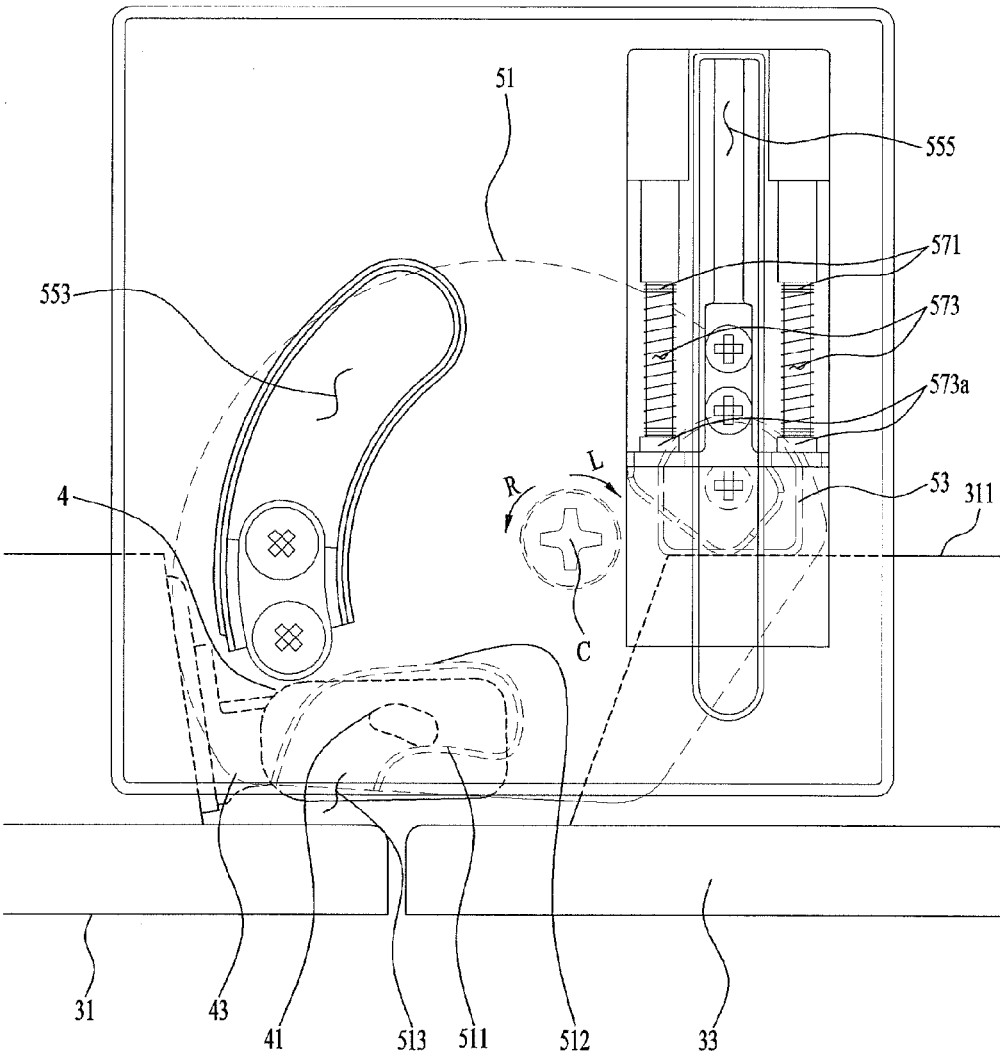
FIG. 17 is a diagram illustrating an example state representing that a first door and a second door are closed.
Figure 18:
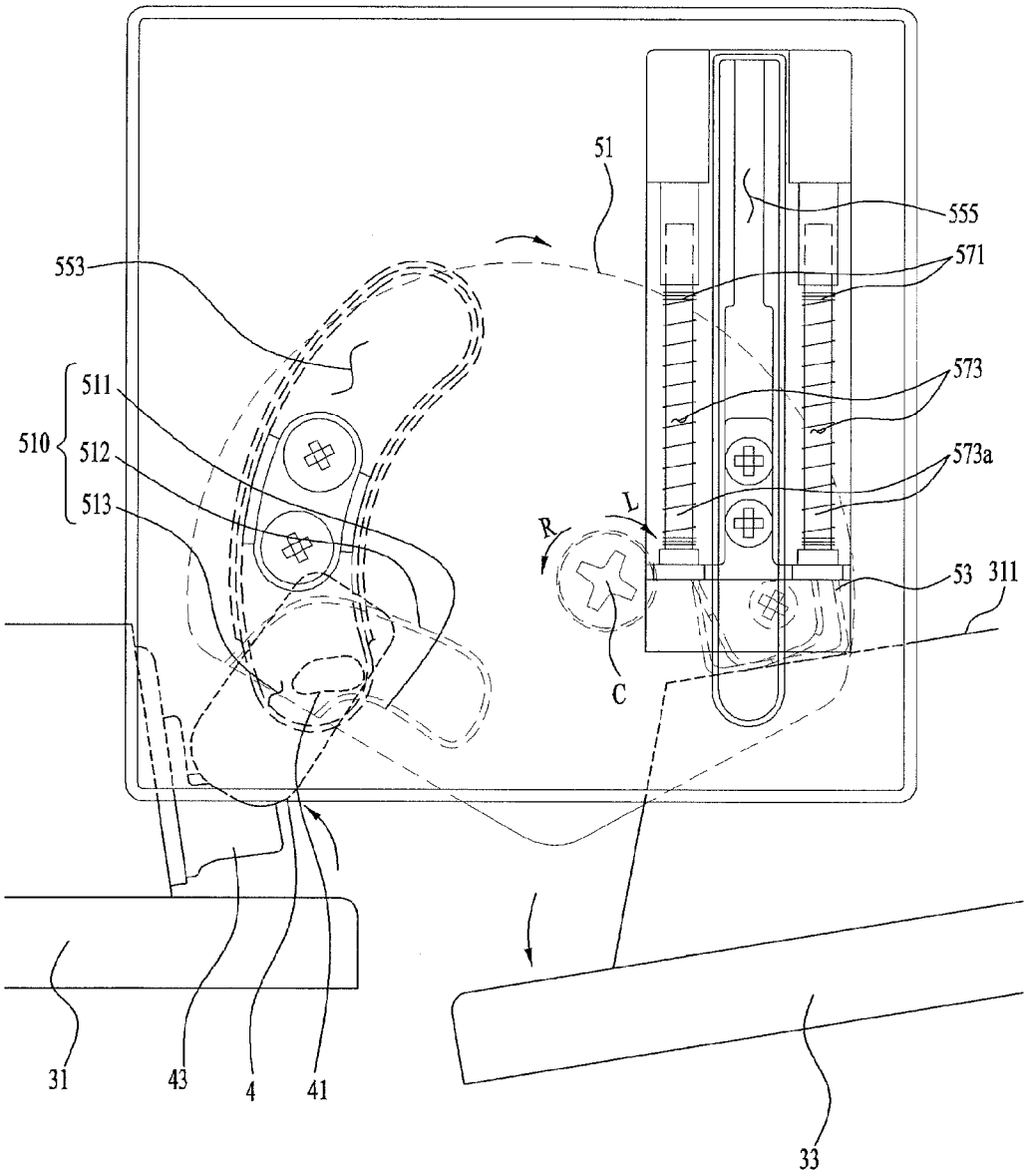
FIG. 18 is a diagram illustrating an example state representing that a second door is being opened.
Figure 19:
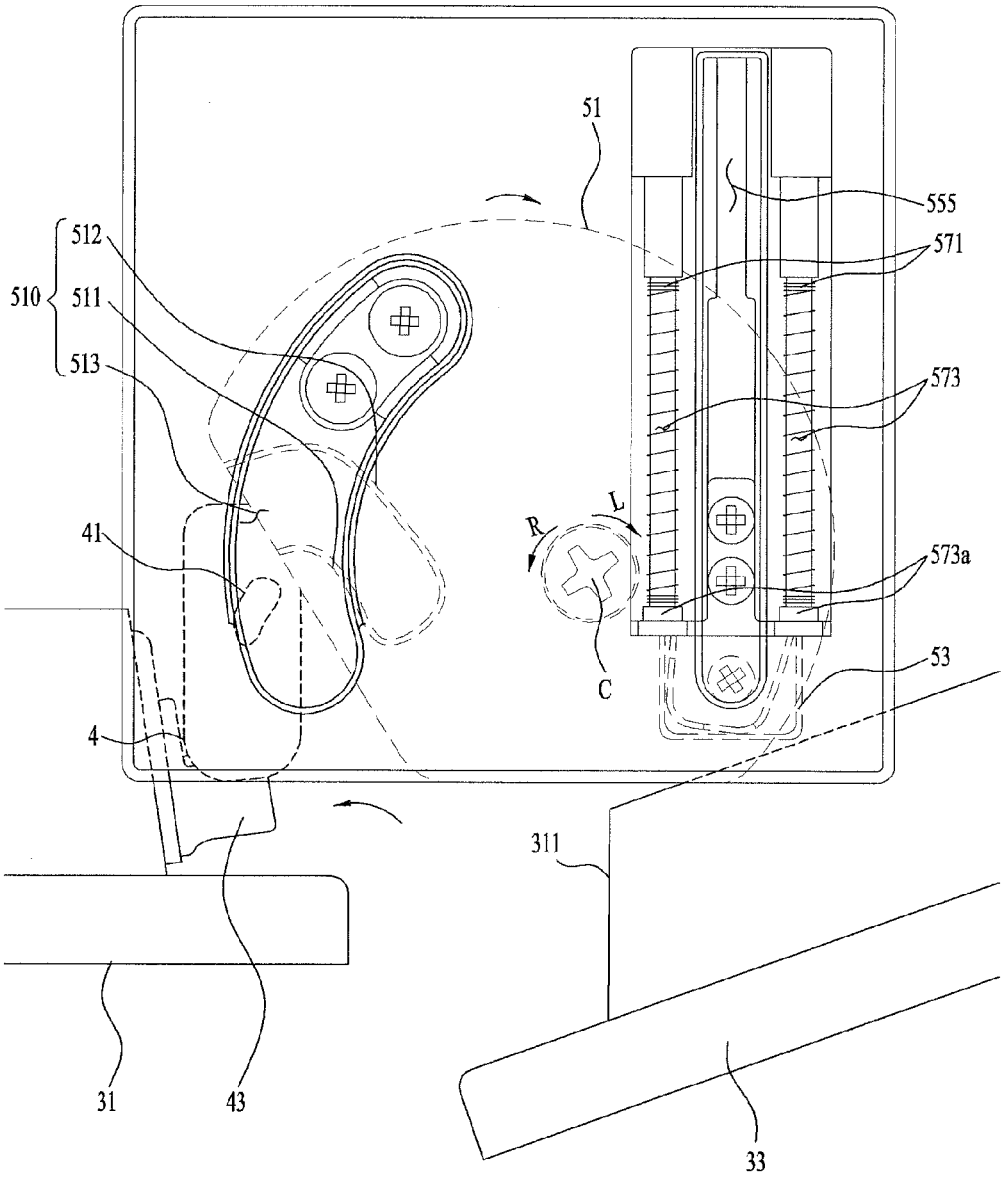
FIG. 19 is a diagram illustrating an example state representing that a second door is opened.
Figure 20:
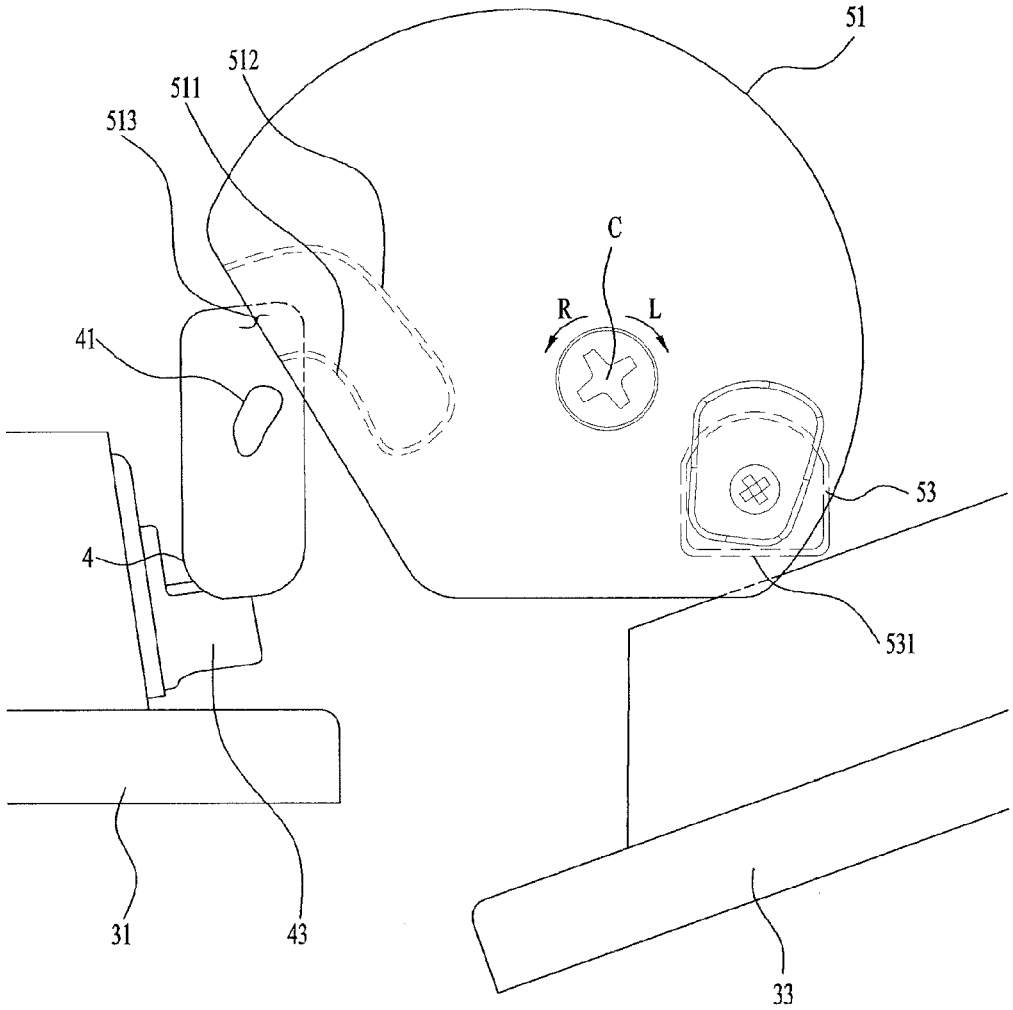
FIG. 20 is a diagram illustrating another example state representing that a second door is opened.
Figure 21:
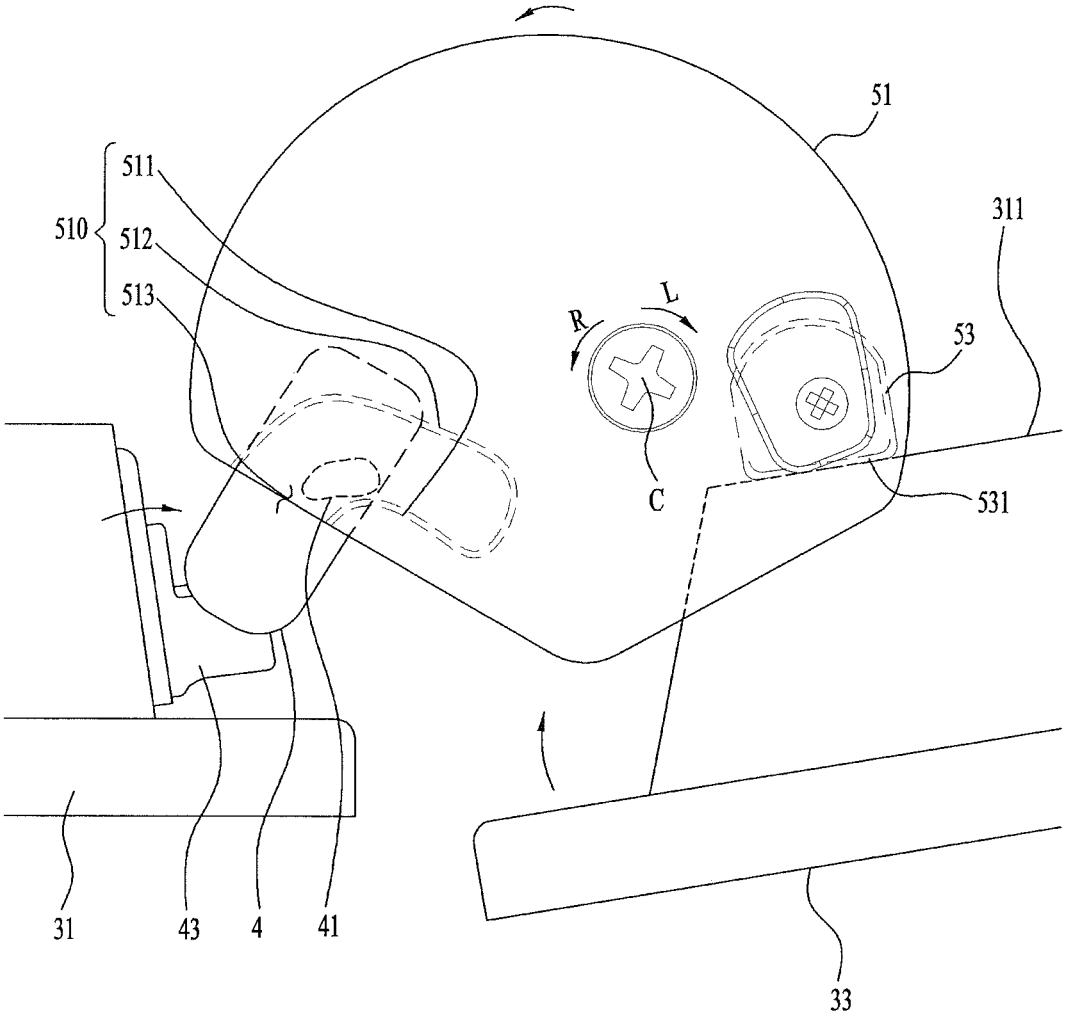
FIG. 21 is a diagram illustrating an example state representing that a second door is being closed.
Figure 22:
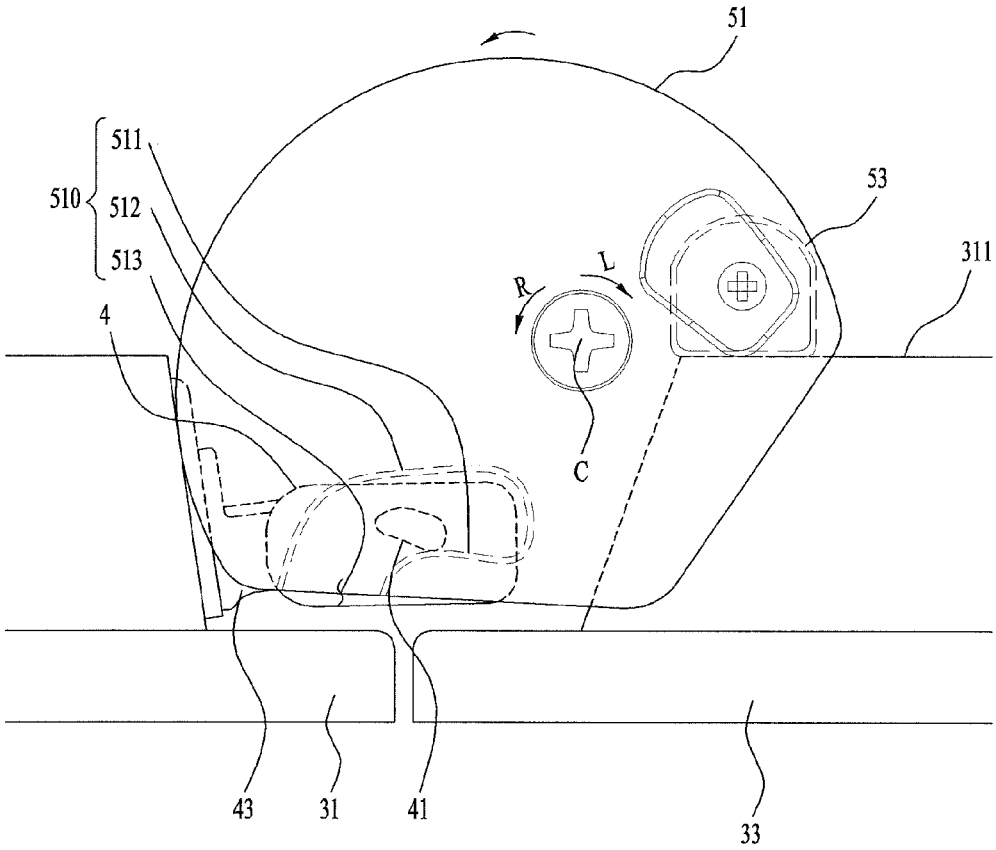
FIG. 22 is a diagram illustrating an example state representing that a second door is closed.

FIG. 11 illustrates another example state representing that a second door is opened. FIG. 12 illustrates an example state representing that a second door is being closed. FIG. 13 illustrates an example state representing that a second door is closed. An unfolding configuration of the pillar 4 when the second door 33 is closed will be described with reference to FIGS. 11-13.

FIG. 11 illustrates a state in which the second door 33 is opened. In such a state, the rotator 51 is rotated in the second direction L to the maximum extent by the elastic member 571 (see FIG. 11), and the pillar 4 is folded. In addition, the protruding member 53 is moved toward the second door 33.

Referring to FIG. 12, when the second door 33 is being closed, the second door 33 is in contact with the protruding member 53. The closing force of the second door 33 is transmitted through the protruding member 53 to the rotator 51 so as to rotate the rotator 51 in the first direction R. As such, the guide recess 510 formed in the rotator 51 is also rotated in the first direction R.

In this example, the pillar boss 41 is inserted into the guide recess 510 through the insertion portion 513. The second slope 512 applies force to the pillar boss 41 in the direction in which the pillar 4 is rotated (i.e. the second direction L), and comes into contact with the pillar boss 41 so as to guide the pillar boss 41.

Accordingly, as exemplarily illustrated in FIG. 13, the pillar 4 is unfolded when the second door 33 is completely closed, thereby preventing leakage of cold air between the first door 31 and the second door 33.

In some implementations, the pillar boss 41 is guided by the second slope 512 and is unfolded when the pillar 4 is rotated beyond the first angle.

As described above, as the rotator 51 is rotated when the second door 33 is opened or closed, the guide recess 510 is also rotated, and the pillar boss 41 is guided by the rotating guide recess 510. With this operation, the refrigerator 10 achieves enhanced operation ability compared to a pillar and a pillar guide of the related art.

This is because the guide recess 510 pushes the pillar boss 41 in the direction in which the pillar 4 is rotated, in order to rotate the pillar 4. In other words, since the guide recess 510 pushes the pillar boss 41 in the tangential direction of the radius of rotation of the pillar 4, rather than pushing the pillar boss 41 in the rotation axis direction of the pillar 4, torque applied to the pillar 4 is increased.

FIGS. 14-22 are respectively corresponding to FIGS. 5-13. In FIGS. 14 to 22, the pillar 4 is pivotally provided at the first door 31 using a coupler 43 and is secured to the side surface of the door basket 311 provided at the first door 31.

When a user opens a door and pulls out a vegetable pulled out from a storage compartment, there occurs no interference between a pillar and the vegetable box, which may result in increased convenience of use.

In addition, a door basket does not interfere a pillar when a door is opened. Thus, a refrigerator may increase the practical storage capacity of the door basket.

In addition, a pillar is folded when a door is opened. Thus, a refrigerator can have more storage capacity.

What is claimed is:

1. A refrigerator comprising:
- a cabinet;
- a storage compartment located within the cabinet;
- a first door pivotally mounted to the cabinet, the first door configured to open or close a first portion of the storage compartment;
- a second door pivotally mounted to the cabinet, the second door configured to open or close a second portion of the storage compartment;
- a pillar pivotally mounted to the first door and configured to block leakage of cold air between the first door and the second door;
- a pillar boss protruding outward from the pillar;
- a guide recess configured to guide the pillar boss; and
- a rotator that defines the guide recess, the rotator being configured to rotate about a rotation axis,
- wherein the rotator is configured to rotate in a first direction based on closing force of the second door.

2. The refrigerator according to claim 1, wherein the guide recess includes:
- an insertion portion configured to receive the pillar boss;
- a first slope coupled to the insertion portion, the first slope having a convex shape; and
- a second slope coupled to the insertion portion, the second slope having a concave shape.

3. The refrigerator according to claim 2, further comprising a protruding member protruding from the rotator,
- wherein the protruding member is configured to contact the second door and the rotator is configured to rotate in the first direction based on the closing force of the second door.

4. The refrigerator according to claim 3, wherein the second slope is configured to guide the pillar boss and the pillar is configured to be unfolded based on a first rotation of the rotator in the first direction.

5. The refrigerator according to claim 3, further comprising an elastic member coupled to the rotator and configured to rotate the rotator in a second direction based on elastic force of the elastic member.

6. The refrigerator according to claim 5, further comprising:
- a first guide configured to guide the elastic member, the elastic member being fitted to the first guide;
- a second guide configured to guide the first guide;
- an expanded portion coupled to one end of the first guide, a diameter of the expanded portion being larger than a diameter of the first guide; and a through-hole in the second guide, the through-hole being configured to fit the other end of the first guide, wherein the expanded portion is connected to the rotator.

7. The refrigerator according to claim 6, wherein the elastic member includes two elastic member units and the first guide includes two first guide units, and the protruding member is located between the two elastic member units.

8. The refrigerator according to claim 5, wherein the first slope is configured to guide the pillar boss and the pillar is configured to be folded based on a second rotation of the rotator in the second direction.

9. The refrigerator according to claim 5, wherein the elastic force of the elastic member is configured to be smaller than the closing force of the second door.

10. The refrigerator according to claim 9, wherein the pillar includes a pillar spring configured to retain a position of the pillar, and wherein the elastic force of the elastic member is configured to be larger than inertia force of the pillar spring.

11. The refrigerator according to claim 10, wherein the pillar boss is configured to, based on opening force of the first door, slide on the first slope and exit the insertion portion, and the pillar is configured to be folded after the pillar boss exits the insertion portion.

12. The refrigerator according to claim 10, wherein the pillar boss is configured to, based on closing force of the first door, enter the insertion portion and inwardly slide on the second slope, and the pillar is configured to be unfolded based on the pillar boss sliding on the second slope.

13. The refrigerator according to claim 5, wherein the elastic member is spaced apart from a rotation axis of the rotator.

14. A refrigerator comprising:

a cabinet;

a storage compartment located within the cabinet;

a first door pivotally mounted to the cabinet, the first door configured to open or close a first portion of the storage compartment;

a second door pivotally mounted to the cabinet, the second door configured to open or close a second portion of the storage compartment;

a pillar rotatably mounted to the first door and configured to seal a gap between the first door and the second door;

a rotator rotatably mounted to a ceiling of the storage compartment, the rotator rotating in a first direction based on closing force of the second door;

a pillar boss protruding outward from the pillar;

a guide recess that is coupled to the rotator and that is configured to guide the pillar boss; and an elastic member configured to rotate the rotator in a second direction based on elastic force of the elastic member, wherein the pillar is configured to be unfolded based on a first rotation of the rotator in the first direction, and is configured to be folded based on a second rotation of the rotator in the second direction.

15. The refrigerator according to claim 14, wherein the guide recess includes:

an insertion portion configured to receive the pillar boss;

a first slope, having a convex shape, configured to guide the pillar boss being removed from the insertion portion; and a second slope, having a concave shape, configured to guide the pillar boss being inserted into the insertion portion.

16. The refrigerator according to claim 15, wherein the guide recess rotates in a second direction and the first slope is configured to rotate the pillar boss in the first direction based on opening force of the second door.

17. The refrigerator according to claim 15, wherein the guide recess rotates in the first direction and the second slope is configured to rotate the pillar boss in the second direction based on closing force of the second door.

18. The refrigerator according to claim 15, wherein the rotator is configured to rotate in the first direction to a maximum extent and remain static after the second door is closed.

* * * * *